US011112750B2

(12) United States Patent
Lee et al.

(10) Patent No.: US 11,112,750 B2
(45) Date of Patent: Sep. 7, 2021

(54) DEVELOPMENT CARTRIDGE HAVING A SWITCH MEMBER TO ROTATE DEVELOPING UNIT TO A DEVELOPMENT POSITION

(71) Applicant: HEWLETT-PACKARD DEVELOPMENT COMPANY, L.P., Spring, TX (US)

(72) Inventors: Sang-hoon Lee, Suwon-si (KR); Seung-beom Yang, Suwon-si (KR); Seung-gweon Lee, Suwon-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/870,222

(22) Filed: May 8, 2020

(65) Prior Publication Data

US 2020/0272093 A1 Aug. 27, 2020

Related U.S. Application Data

(63) Continuation of application No. 15/614,152, filed on Jun. 5, 2017, now Pat. No. 10,698,362.

(30) Foreign Application Priority Data

Nov. 14, 2016 (KR) ..... 10-2016-0151308

(51) Int. Cl.
*G03G 21/18* (2006.01)
*G03G 15/01* (2006.01)
(Continued)

(52) U.S. Cl.
CPC ..... *G03G 21/1821* (2013.01); *G03G 15/0173* (2013.01); *G03G 15/04* (2013.01);
(Continued)

(58) Field of Classification Search
CPC ..... G03G 21/1821
(Continued)

(56) References Cited

U.S. PATENT DOCUMENTS 5,933,688 A 8/1999 Suzuki et al.
2003/0156864 A1 8/2003 Tachiki et al.
(Continued)

FOREIGN PATENT DOCUMENTS

CN 1652039 8/2005
CN 1991619 7/2007
(Continued)

*Primary Examiner* — Walter L Lindsay, Jr.
*Assistant Examiner* — Philipmarcus T Fadul
(74) *Attorney, Agent, or Firm* — Staas & Halsey, LLP

(57) ABSTRACT

A development cartridge for an image forming apparatus includes a photoconductive unit including a photoconductive drum, a developing unit including a developing roller having a rotation shaft and coupled to the photoconductive unit to be rotatable to a release position where the developing roller is separated from the photoconductive drum, and to a development position where the developing roller contacts the photoconductive drum, and a coupler located between and couplable to the rotation shaft of the developing roller and a rotational power transmission member. When the coupler is coupled to the rotational power transmission member, the coupler is selectively rotatable in a first rotation direction or a second rotation direction by a rotational force from the rotational power transmission member. When the coupler is rotated in the first rotation direction and then in the second rotation direction, transmission of the rotational force to the developing roller is partially interrupted.

25 Claims, 18 Drawing Sheets

(51) Int. Cl.

| | |
|---|---|
| ***G03G 15/04*** | (2006.01) |
| ***G03G 15/08*** | (2006.01) |
| *G03G 15/00* | (2006.01) |
| *G03G 21/16* | (2006.01) |

(52) U.S. Cl.
CPC ..... *G03G 15/0865* (2013.01); *G03G 21/1825* (2013.01); *G03G 21/1853* (2013.01); *G03G 21/1857* (2013.01); *G03G 15/757* (2013.01); *G03G 21/1647* (2013.01); *G03G 21/1676* (2013.01)

(58) Field of Classification Search
USPC ..... 399/111
See application file for complete search history.

(56) References Cited

U.S. PATENT DOCUMENTS

| | | | | |
|---|---|---|---|---|
| 2007/0147896 | A1 | 6/2007 | Choi | |
| 2007/0248382 | A1 | 10/2007 | Oguma et al. | |
| 2009/0097884 | A1 | 4/2009 | Kim et al. | |
| 2012/0321342 | A1 | 12/2012 | Mori | |
| 2013/0051848 | A1 | 2/2013 | Itabashi et al. | |
| 2013/0164028 | A1 | 6/2013 | Morioka et al. | |
| 2016/0179051 | A1* | 6/2016 | Kim ..... | G03G 21/1821 399/113 |
| 2016/0252878 | A1 | 9/2016 | Kimura et al. | |

FOREIGN PATENT DOCUMENTS

| | | |
|---|---|---|
| EP | 1096339 | 5/2001 |
| JP | 200724973 A | 2/2007 |

* cited by examiner

DEVELOPMENT CARTRIDGE HAVING A SWITCH MEMBER TO ROTATE DEVELOPING UNIT TO A DEVELOPMENT POSITION

CROSS-REFERENCE TO RELATED APPLICATIONS

This application is a continuation of U.S. patent application Ser. No. 15/614,152, filed on Jun. 5, 2017, in the U.S. Patent and Trademark Office, which claims the priority benefit of Korean Patent Application No. 10-2016-0151308, filed on Nov. 14, 2016, in the Korean Intellectual Property Office. U.S. patent application Ser. No. 15/614,152 and Korean Patent Application No. 10-2016-0151308 are incorporated by reference herein in their entirety.

BACKGROUND

The disclosure relates to a development cartridge detachably attached to an electrophotographic image forming apparatus for forming an image onto a recording medium in an electrophotographic manner, and the electrophotographic image forming apparatus employing the development cartridge.

An electrophotographic image forming apparatus operating in an electrophotographic manner prints an image onto a recording medium by forming a visible toner image on a photosensitive body by supplying a toner to an electrostatic latent image formed on the photosensitive body, transferring the toner image to the recording medium, and fixing the transferred toner image to the recording medium. A development cartridge contains a toner (developer) and includes a developing roller that supplies the toner to the electrostatic latent image formed on the photosensitive body.

BRIEF DESCRIPTION OF THE DRAWINGS

FIGS. 2 and 3 are side views of a development cartridge according to an example, wherein FIG. 2 illustrates a state in which a development nip is formed and FIG. 3 illustrates a state in which a development nip is released;

FIGS. 6A and 6B are schematic side views illustrating actions of a switching member according to an example, wherein FIG. 6A illustrates the switching member in a second state and FIG. 6B illustrates the switching member in a first state;

FIGS. 13 and 14 are schematic side views of a power transmission member according to an example, wherein FIG. 13 illustrates the case where a driving gear rotates in the direction D1 and FIG. 14 illustrates the case where the driving gear rotates in the direction D2;

DETAILED DESCRIPTION

Figure 1:
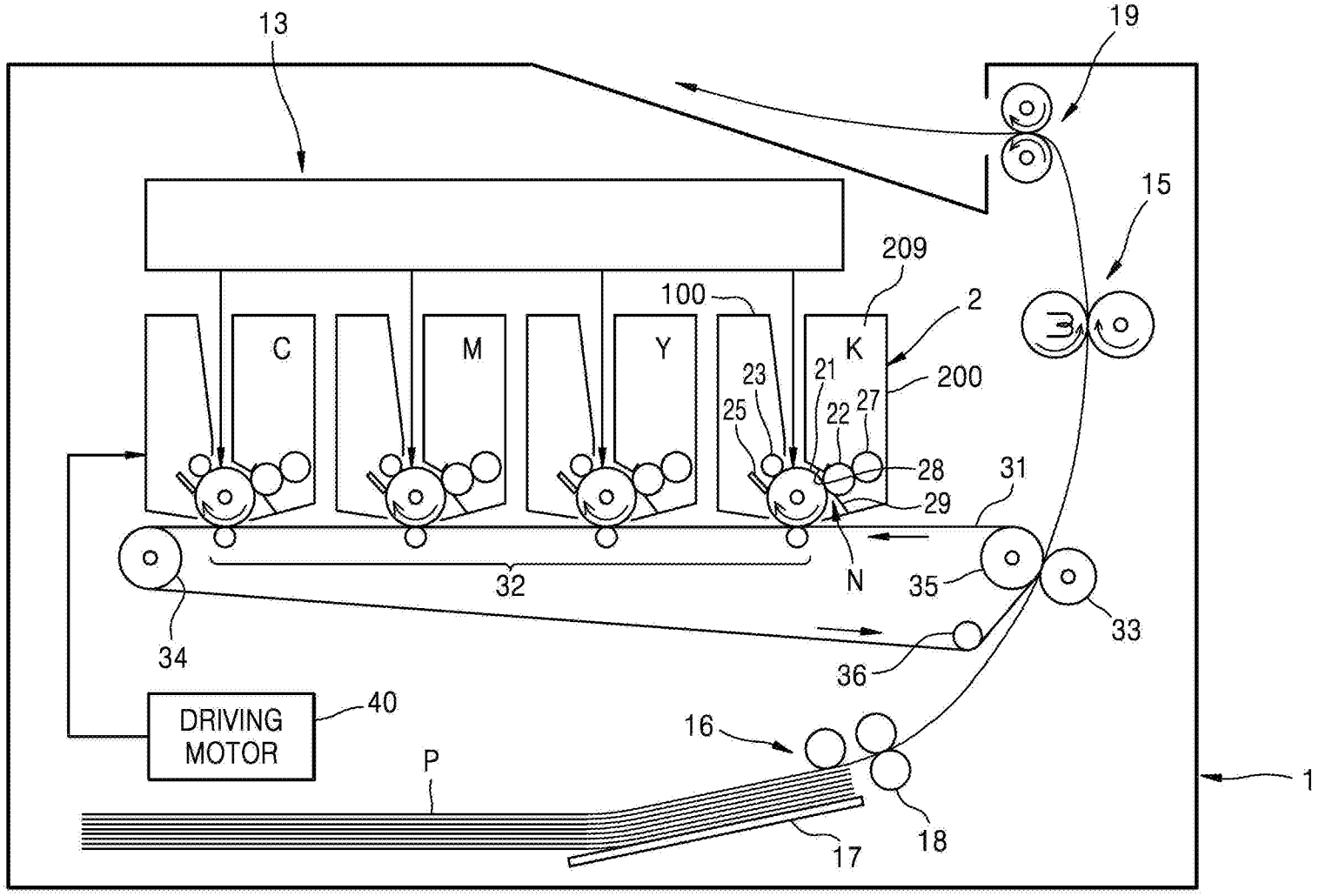
FIG. 1 is a schematic configuration diagram illustrating an electrophotographic image forming apparatus, according to an example.

The disclosure will be described in detail by explaining examples of a development cartridge and an electrophotographic image forming apparatus employing the development cartridge with reference to the attached drawings. Like reference numerals in the drawings denote like elements, and their descriptions will be omitted.

A development cartridge is an assembly of elements for forming the visible toner image. The development cartridge is detachably attached to a main body of the electrophotographic image forming apparatus and is a consumable item to be replaced when its service life is over. In a development cartridge using a contact development manner, a developing roller and the photosensitive body contact each other and thus form a development nip.

When a long time elapses after the development nip is formed, the developing roller may be deformed and the photosensitive body may be damaged. The deformation of the developing roller and the damage of the photosensitive body may cause a change in the development nip, which reduces image quality.

One or more examples include a development cartridge having a compact structure capable of forming/releasing a development nip, and an electrophotographic image forming apparatus employing the development cartridge.

One or more examples include a development cartridge capable of securing a stable position of a developing roller in the development cartridge, and an electrophotographic image forming apparatus employing the development cartridge.

Additional aspects will be set forth in part in the description which follows and, in part, will be apparent from the description, or may be learned by practice of the presented examples.

According to one or more examples, a development cartridge detachable from a main body of an image forming apparatus includes a photoconductive unit including a photoconductive drum and an interfering portion, a developing unit including a developing roller and coupled to the photoconductive unit to be rotatable to a release position where the developing roller is separated from the photoconductive drum and to a development position where the developing roller contacts the photoconductive drum to form a development nip, an elastic member configured to provide an elastic force to maintain the developing unit at the development position, a coupler connected to a driving motor provided in the main body when the development cartridge is mounted on the main body, and a switching member mounted on a rotation shaft of the developing roller to be rotatable about the rotation shaft of the developing roller by being connected to the coupler and switched to a first state where the switching member contacts the interfering portion and rotates the developing unit to the release position and to a second state where the switching member is separated from the interfering portion and allows the developing unit to rotate to the development position due to the elastic force of the elastic member.

The switching member may include a driving gear provided to be rotatable about the rotation shaft of the developing roller by being connected to the coupler, a cam member including a cam portion, and a partial gear portion selectively interlocked with the coupler, provided to be coaxial with a rotation axis of the driving gear, and rotating to a first position where the cam portion contacts the interfering portion to rotate the developing unit to the release position and to a second position where the cam portion is separated from the interfering portion to allow the developing unit to rotate from the release position to the development position due to the elastic force of the elastic member, according to a rotating direction of the driving gear, and a clutch member configured to connect the cam member to the driving gear such that the partial gear portion interlocks with the coupler when the driving gear rotates in at least one of two directions.

The driving gear may rotate in a first direction during printing and rotate in a second direction during non-printing. The cam member may rotate to the second and first positions when the driving gear rotates in the first and second directions, respectively.

The development cartridge may further include first and second stoppers configured to contact the cam portion to stop the cam member not to rotate beyond the first and second positions when the cam member is located to the first and second positions. The clutch member may include a friction member configured to provide a frictional force between the cam member and the driving gear.

When the cam member is at the first and second positions, the partial gear portion may be separated from the coupler.

The cam member may include a first member including the partial gear portion, and a second member including the cam portion and rotating by being pushed to the first member. When the cam member is at the first and second positions, the partial gear portion may be separated from the coupler.

The first member may include first and second ends that push the second member when the first member rotates in the first and second directions. The second member may include third and fourth ends corresponding to the first and second ends. An angle between the third and fourth ends may be greater than an angle between the first and second ends.

The clutch member may include a latch portion and a guiding portion having a long hole shape, which are provided on the ca m member, a first inner gear portion provided on the driving gear, and a latch gear interlocking with the first inner gear portion, provided on the guiding portion, and interlocking with the latch portion such that the cam member rotates together with the driving gear, when the driving gear rotates in the second direction, and separated from the latch portion when the driving gear rotates in the first direction.

The development cartridge may further include a stopper configured to contact the cam portion to stop the cam member not to rotate beyond the second position when the cam member is located to the second position. When the cam member is at the first position, the partial gear portion may be in mesh with the coupler, and, when the cam member is at the second position, the partial gear portion may be separated from the coupler.

The clutch member may include a latch member positioned on a same axis as a rotation axis of the driving gear between the driving gear and the cam member, and movable in an axial direction, first and second latch portions respectively provided on the latch member and the cam member, and separated from each other when the latch member rotates in the first direction and interlocking with each other such that the cam member also rotates when the latch member rotates in the second direction, a first protrusion provided on the driving gear, and a concave portion provided on the latch member such that the first protrusion fits onto the concave portion, and including first and second opposite surfaces that the first protrusion respectively contacts when the driving gear rotates in the first and second directions, and a connecting surface that connects the first and second opposite surfaces to each other and guides the first protrusion such that, when the driving gear rotates in the second direction, the latch member is pushed toward the cam member.

The connecting surface may include an inclined surface of which a depth gradually decreases starting from the first opposite surface.

The connecting surface may include a first connecting surface positioned near the first opposite surface, a second connecting surface having a smaller depth than the first connecting surface and positioned near the second opposite surface, and a third connecting surface that is inclined and connects the first and second connecting surface to each other.

The development cartridge may further include a stopper configured to contact the cam portion to stop the cam member not to rotate beyond the second position when the cam member is located to the second position. When the cam member is at the first position, the partial gear portion may be in mesh with the coupler, and, when the cam member is at the second position, the partial gear portion may be separated from the coupler.

The development cartridge may further include a bush coupled to the rotation shaft of the developing roller, and a power transmission member configured to transmit a rotational force of the driving gear to the bush when the driving gear rotates in the first direction, and to partially block the rotational force of the driving gear from being transmitted to the bush when the driving gear rotates in the second direction.

The power transmission member may include a second protrusion provided on the driving gear, and an interlocking portion provided on the bush and interlocking with the second protrusion. Given that a sum of lengths of the interlocking portion and the second protrusion in a circumferential direction is L1 and a rotational angle of the driving gear in the second direction while the developing unit is being rotated from the development position to the release position is L2, 360−L1 may be greater than L2.

The power transmission member may include a development latch member positioned on a same axis as a rotation axis of the driving gear between the driving gear and the bush, and movable in an axial direction, first and second latch portions respectively provided on the development latch member and the bush, and interlocking with each other to transmit a rotational force of the development latch member to the bush when the development latch member rotates in the first direction and separated from each other when the development latch member rotates in the second direction, a protrusion provided on the driving gear, and a concave portion provided on the development latch member such that the protrusion fits onto the concave portion, and including first and second opposite surfaces that the protrusion respectively contacts when the driving gear rotates in the first and second directions, and a connecting surface that connects the first and second opposite surfaces to each other and guides the protrusion such that, when the driving gear rotates in the first direction, the development latch member is pushed toward the bush.

The power transmission member may include a latch portion and a guiding portion having a long hole shape, which are provided on the bush, a second inner gear portion provided on the driving gear, and a latch gear interlocking with the second inner gear portion, provided on the guiding portion, and interlocking with the latch portion such that the bush rotates together with the driving gear, when the driving gear rotates in the first direction, and separated from the latch portion when the driving gear rotates in the second direction.

According to one or more examples, an electrophotographic image forming apparatus includes a main body, and the above-described development cartridge detachable from the main body.

FIG. 1 is a schematic configuration diagram illustrating an electrophotographic image forming apparatus, according to an example. The electrophotographic image forming apparatus (also referred to as an image forming apparatus) according to the example prints a color image to a recording medium P, according to an electrophotographic manner. Referring to FIG. 1, the image forming apparatus may include a main body 1 and a plurality of development cartridges 2. The plurality of development cartridges 2 are detachably attached to the main body 1. An exposure device 13, a transfer device, and a fixing device 15 are arranged at the main body 1. In addition, a recording medium transport unit for loading and transporting the recording medium P to which an image is to be formed is arranged at the main body 1.

For color printing, the plurality of development cartridges 2 may include four development cartridges 2 for developing images with cyan color, magenta color, yellow color, and black color, respectively. Developers, e.g., toners, of cyan (C) color, magenta (M) color, yellow (Y) color, and black (K) color may be contained in the four development cartridges 2, respectively. Although not illustrated, the toners of cyan color, magenta color, yellow color, and black color may be respectively contained in four toner supply containers, and may be respectively supplied from the four toner supply containers to the four development cartridges 2. The image forming apparatus may further include development cartridges 2 for containing and developing toners of other various colors such as a light magenta color, a white color, or the like. Hereinafter, the image forming apparatus including the four development cartridges 2 will now be described, and unless there is a particular description contrary thereto, items with reference characters C, M, Y, and K indicate elements for developing images with cyan color, magenta color, yellow color, and black color, respectively.

In the example, each of the four development cartridges 2 is an integrated development cartridge. Each development cartridge 2 may include a photoconductive unit 100 and a developing unit 200.

The photoconductive unit 100 includes a photoconductive drum 21. The photoconductive drum 21, as a photosensitive body on which an electrostatic latent image is formed, may include a conductive metal pipe and a photosensitive layer formed at an outer circumference of the conductive metal pipe. A charging roller 23 is an example of a charger that charges a surface of the photoconductive drum 21 to have a uniform surface potential. Instead of the charging roller 23, a charging brush, a corona charger, or the like may be used. The photoconductive unit 100 may further include a cleaning roller (not shown) for removing foreign substances attached to a surface of the charging roller 23. A cleaning blade 25 is an example of a cleaning member that removes residual toners and foreign substances attached to the surface of the photoconductive drum 21 after a transfer process to be described below. Instead of the cleaning blade 25, a cleaning device in another form, such as a rotating brush, may be used.

The developing unit 200 includes a toner container 209. The developing unit 200 supplies a toner in the toner container 209 to an electrostatic latent image formed on the photoconductive drum 21, thereby developing the electrostatic latent image into a visible toner image. A developing method may include a one-component developing method using a toner and a two-component developing method using a toner and a carrier. In the example, the developing unit 200 employs the one-component developing method. A developing roller 22 supplies a toner to the photoconductive drum 21. A developing bias voltage may be applied to the developing roller 22 to supply the toner to the photoconductive drum 21.

In the example, a contact development technique in which the developing roller 22 and the photoconductive drum 21 contact each other and thus form a development nip N is used. A supply roller 27 supplies the toner in the toner container 209 to a surface of the developing roller 22. To this end, a supply bias voltage may be applied to the supply roller 27. The developing unit 200 may further include a regulation member 28 for regulating an amount of toner to be supplied to the development nip N where the photoconductive drum 21 and the developing roller 22 contact each other due to the developing roller 22. For example, the regulation member 28 may be a doctor blade that elastically contacts the surface of the developing roller 22. The developing unit 200 may further include a bottom sealing member 29 that contacts the developing roller 22 opposite to the regulation member 28 so as to prevent toner leakage. The bottom sealing member 29 may be a film that contacts the developing roller 22.

The exposure unit 13 radiates light modulated in correspondence with image information onto the photoconductive drum 21 and forms the electrostatic latent image. Examples of the exposure device 13 may include a laser scanning unit (LSU) using a laser diode as a light source and a light-emitting diode (LED) exposure device using an LED as a light source.

A transfer device may include an intermediate transfer belt 31, a first transfer roller 32, and a second transfer roller 33. The intermediate transfer belt 31 temporarily receives a toner image developed on the photoconductive drum 21 of each of the development cartridges 2C, 2M, 2Y, and 2K. The intermediate transfer belt 31 is circulated while being supported by supporting rollers 34, 35, and 36. Four first transfer rollers 32 are positioned to face the photoconductive drums 21 of the development cartridges 2C, 2M, 2Y, and 2K with the intermediate transfer belt 31 therebetween. A first transfer bias voltage is applied to the four first transfer rollers 32 so as to firstly transfer toner images, which are developed on the photoconductive drums 21, to the intermediate transfer belt 31. Instead of the first transfer rollers 32, a corona transfer device or a pin scorotron-type transfer device may be used. The second transfer roller 33 is positioned to face the intermediate transfer belt 31. A second transfer bias voltage is applied to the second transfer roller 33 so as to transfer, to the recording medium P, the toner images that are firstly-transferred to the intermediate transfer belt 31.

When a print command is transmitted from a host (not shown) or the like, a controller (not shown) charges, by using the charging roller 23, the surface of the photoconductive drum 21 to have a uniform surface potential. The exposure device 13 forms electrostatic latent images on the photoconductive drums 21 by scanning four light-beams to the photoconductive drums 21 of the development cartridges 2C, 2M, 2Y, and 2K, the four light-beams being modulated according to image information corresponding to cyan, magenta, yellow, and black colors, respectively. The developing rollers 22 of the development cartridges 2C, 2M, 2Y, and 2K supply C, M, Y, and K toners to the photoconductive drums 21, respectively, thereby developing the electrostatic latent images into visible toner images. The developed toner images are firstly transferred to the intermediate transfer belt 31. The recording mediums P loaded on a loading plate 17 are output one by one by a pick-up roller 16, and are transported to a transfer nip by a feed roller 18, the transfer nip being formed by the second transfer roller 33 and the intermediate transfer belt 31. The toner images that are firstly-transferred to the intermediate transfer belt 31 are secondly transferred to the recording medium P due to the second transfer bias voltage applied to the second transfer roller 33. When the recording medium P passes through the fixing device 15, the toner images are fixed on the recording medium P due to heat and pressure. The recording medium P on which fixing has been completed is externally discharged by a discharging roller 19.

The development cartridges 2C, 2M, 2Y, and 2K may be detachably attached to the main body 1 through a door (not shown).

During image formation, the developing roller 22 and the photoconductive drum 21 contact each other and thus form the development nip N. However, when the contact between the developing roller 22 and the photoconductive drum 21 is maintained while image formation is not being performed, deformation of the developing roller 22 and damage of the photosensitive body may occur. In addition, when a plurality of images are continuously printed, if the photoconductive drum 21 and the developing roller 22 maintain their contact during an image non-forming period between image forming periods, a toner on the developing roller 22 is delivered to the photoconductive drum 21 during the image non-forming period, and thus an amount of toner consumption may be increased and waste toner may be increased. Since the photoconductive drum 21 and the developing roller 22 rotate while contacting each other, stress is applied to the developing roller 22, and thus the lifespan of the developing roller 22 may be decreased.

Figure 2:
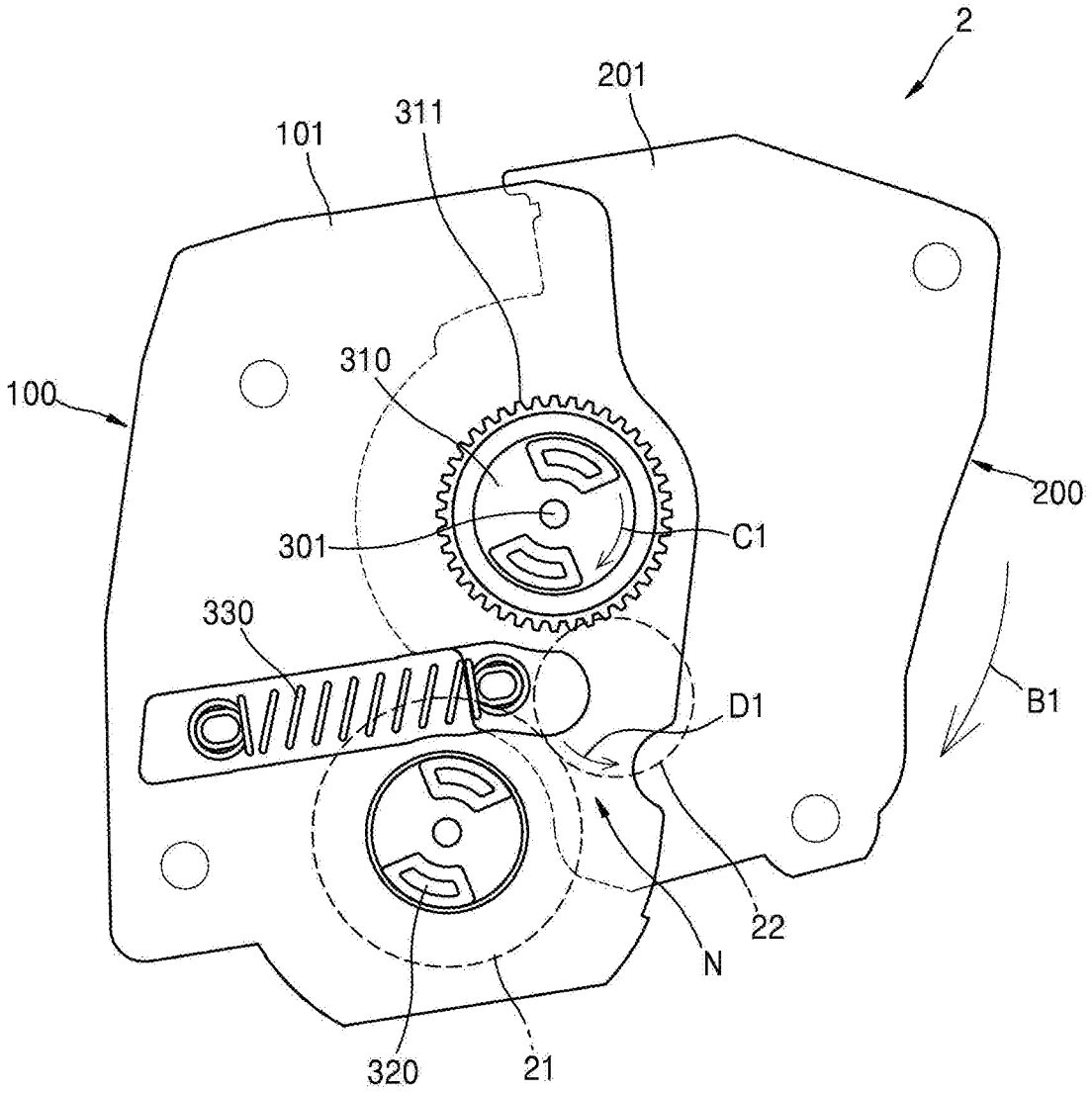
Figure 3:
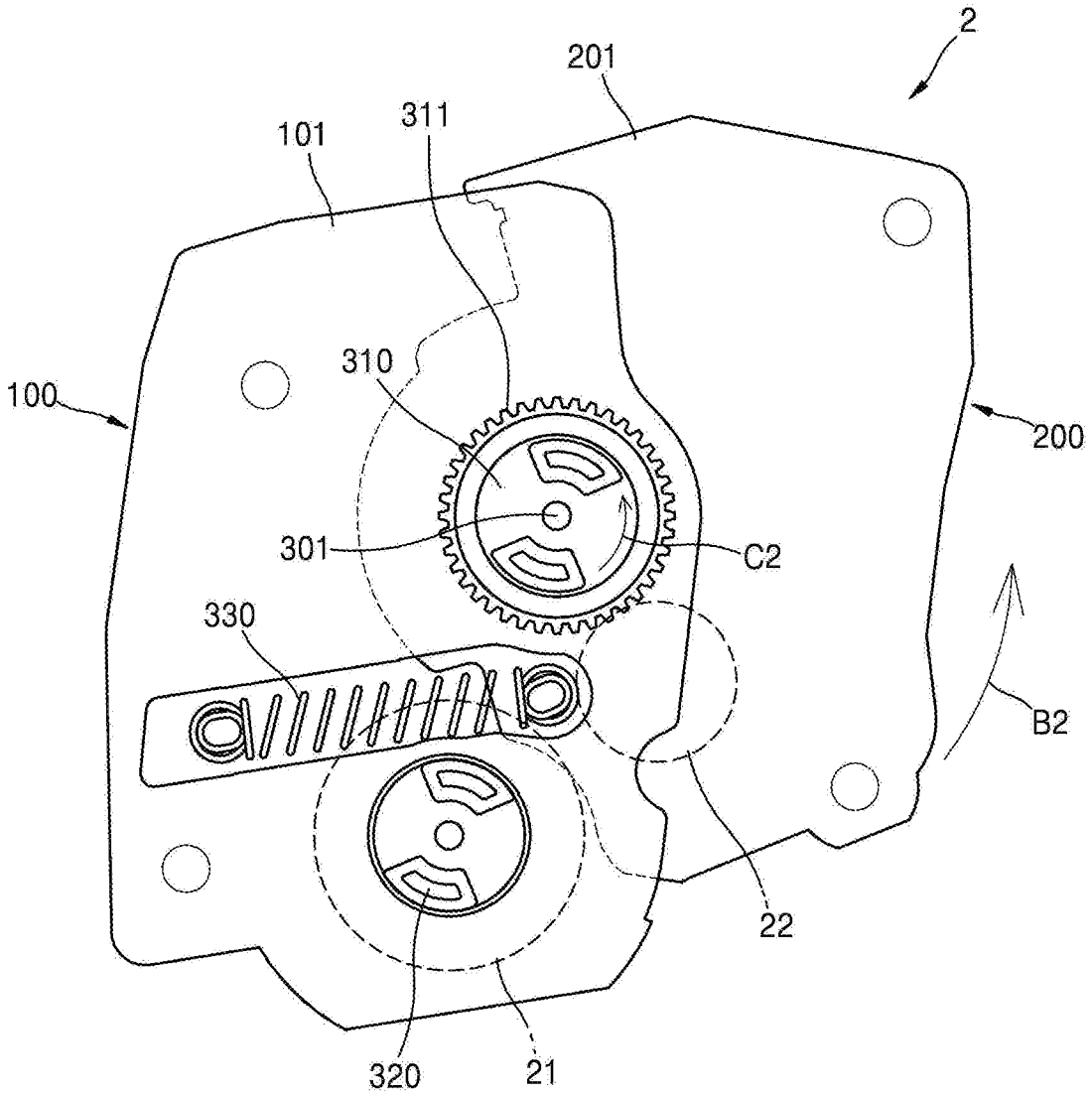

FIGS. 2 and 3 are side views of the development cartridge 2, according to an example. FIG. 2 illustrates a state in which the photoconductive drum 21 and the developing roller 22 contact each other so that the development nip N is formed. FIG. 3 illustrates a state in which the photoconductive drum 21 and the developing roller 22 are spaced apart from each other so that the development nip N is released.

Referring to FIGS. 2 and 3, the development cartridge 2 includes the photoconductive unit 100 and the developing unit 200. The photoconductive unit 100 may include a first frame 101 and the photoconductive drum 21 supported by the first frame 101. The developing unit 200 may include a second frame 201 and the developing roller 22 supported by the second frame 201. The photoconductive unit 100 and the developing unit 200 are connected to each other so as to rotate to a development position (refer to FIG. 2) where the photoconductive drum 21 and the developing roller 22 contact each other to form the development nip N and a release position (refer to FIG. 3) where the photoconductive drum 21 and the developing roller 22 are spaced apart from each other to release the development nip N. For example, the photoconductive unit 100 and the developing unit 200 are connected to rotate to the development position and the release position with respect to a hinge axis 301. In the image forming apparatus, the photoconductive drum 21 is related to a position of the first transfer roller 32 or the like, and thus, when the development cartridge 2 is mounted to the main body 1, a position of the photoconductive drum 21 is fixed. The developing unit 200 is coupled to the photoconductive unit 100 so as to be rotatable with respect to the hinge axis 301.

Rotational members of the development cartridge 2, e.g., the photoconductive drum 21, the developing roller 22, and the supply roller 27, may be driven by being connected to a driving motor 40 arranged at the main body 1 when the development cartridge 2 is mounted to the main body 1. The driving motor 40 may drive all of the four development cartridges 2, or four driving motors 40 may be respectively arranged with respect to the four development cartridges 2.

For example, a coupler 310 may be arranged at the development cartridge 2 so as to be connected to the driving motor 40 at the main body 1 when the development cartridge 2 is mounted to the main body 1. The rotational members may be connected to the coupler 310 by using a power connecting member (not shown), e.g., gears. A coupler 320 may be further arranged at the development cartridge 2 so as to be connected to the driving motor 40 at the main body 1 when the development cartridge 2 is mounted to the main body 1. In this case, the rotational members of the developing unit 200, e.g., the developing roller 22 and the supply roller 27, may rotate by being coupled to the coupler 310, and the rotational member of the photoconductive unit 100, e.g., the photoconductive drum 21, may rotate by being coupled to the coupler 320. The coupler 320 may be positioned to be coaxial with a rotation axis of the photoconductive drum 21 or may be positioned on the rotation axis of the photoconductive drum 21. The hinge axis 301 may be coaxial with the rotation axis of the coupler 310.

An elastic member 330 provides an elastic force to generate the development nip N. The elastic member 330 provides the elastic force to the developing unit 200 such that the developing unit 200 rotates in a direction where the development nip N is to be formed. Due to the elastic force of the elastic member 330, the developing unit 200 rotates with respect to the hinge axis 301, so that the developing roller 22 contacts the photoconductive drum 21, and thus the development nip N may be formed as shown in FIG. 2. FIGS. 2 and 3 illustrate, as an example of the elastic member 330, a tension coil spring of which both ends are supported by the developing unit 200 and the photoconductive unit 100, respectively, but examples of the elastic member 330 are not limited thereto. For example, one of various types of members including a torsion coil spring, a plate spring, and the like may be used as the elastic member 330.

The development cartridge 2 of the example may include a switching member 400 (refer to FIG. 4) to switch the developing unit 200 to the development position where the development nip N is formed or to the release position where the development nip N is released. According to such a structure, because the developing roller 22 is supported by the developing unit 200 and the developing unit 200 rotates to form/release the development nip N, a position of the developing roller 22 with respect to the developing unit 200 does not change. Thus, a structure for mounting the developing roller 22 such that the developing roller 22 may rotate with respect to the developing unit 200 may be simplified.

When the developing unit 200 is located at the development position, the developing roller 22 contacts the photoconductive drum 21 and is located at a development nip forming position where the development nip N is formed. When the developing unit 200 is located at the release position, the developing roller 22 is spaced apart from the photoconductive drum 21, and thus the development nip N is released. The switching member 400 is switched between a first state in which the switching member 400 rotates the developing unit 200 to the release position during a non-printing operation (while an image forming operation is not performed, and an image non-forming period), and a second state in which the switching member 400 allows the developing unit 200 to be rotated to the development position during a printing operation (while an image forming operation is being performed and an image forming period). The switching member 400 rotates the developing unit 200 to the development position and the release position, according to a rotation direction of the switching member 400. The switching member 400 rotates by being coupled to the coupler 310. The switching member 400 may switch the developing unit 200 between the development position and the release position, according to a rotation direction of the coupler 310. For example, when the coupler 310 rotates in a direction C1, the developing roller 22 rotates in a forward direction D1. The direction C1 is a rotating direction during image formation. The switching member 400 maintains the second state. When the coupler 310 rotates in a direction C2, the switching member 400 is switched from the second state to the first state and rotates the developing unit 200 about the hinge axis 301 in a direction B2 to switch the developing unit 200 from the development position to the release position. When the coupler 310 rotates in the direction C1 again, the switching member 400 is switched to the second state and allows the developing unit 200 to rotate about the hinge axis 301 in a direction B1 due to the elastic force of the elastic member 330. Thus, the developing unit 200 is switched from the release position back to the development position.

The switching member 400 according to the example is provided to be coaxial with a rotation axis of the developing roller 22. At least one of the members that constitute the switching member 400 is mounted on the rotation axis of the developing roller 22. Thus, a structure for forming/releasing the development nip N is implemented in the development cartridge 2, and the main body 1 of the image forming apparatus may have a simple structure. In addition, a compact development cartridge 2 capable of forming/releasing the development nip N may be implemented.

Figure 4:
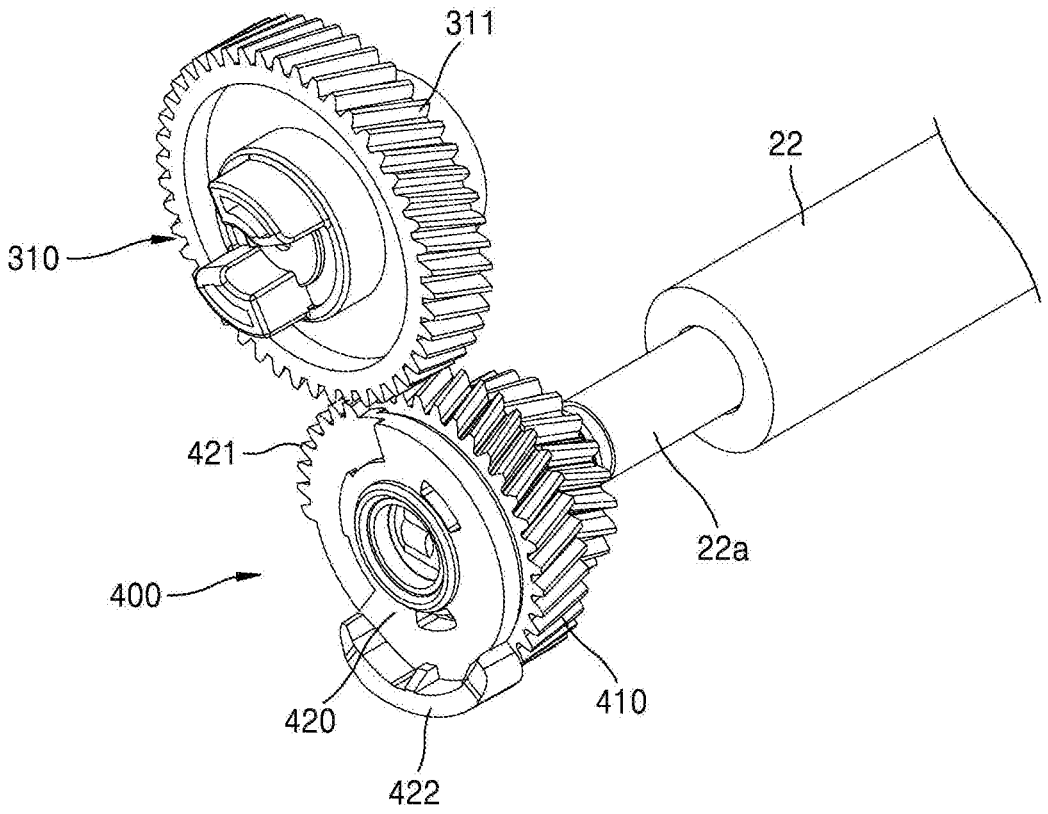
FIG. 4 is a perspective view of a switching member according to an example.
Figure 5:
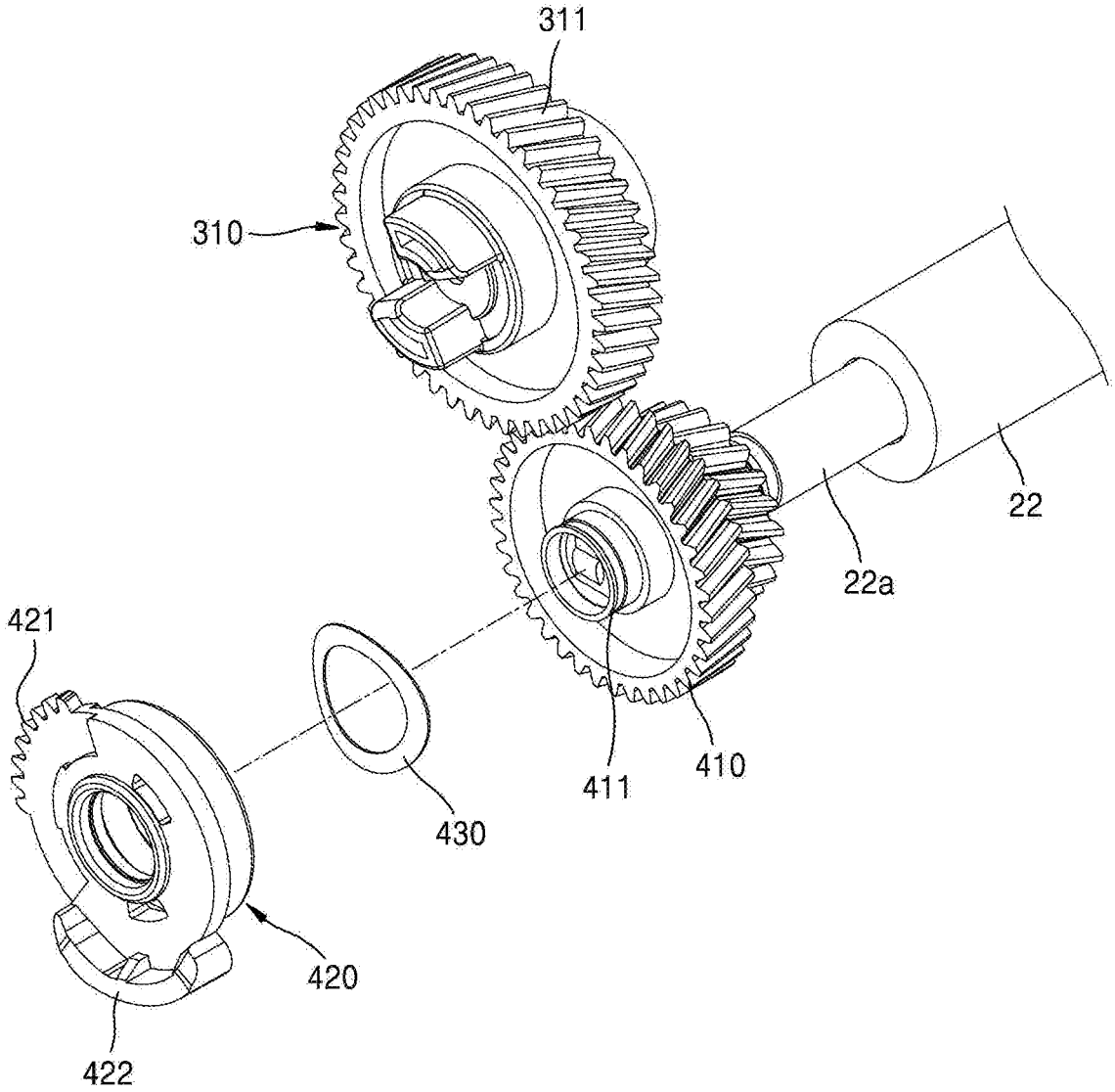
FIG. 5 is an exploded perspective view of an example of the switching member of FIG. 4.
Figure 6A:
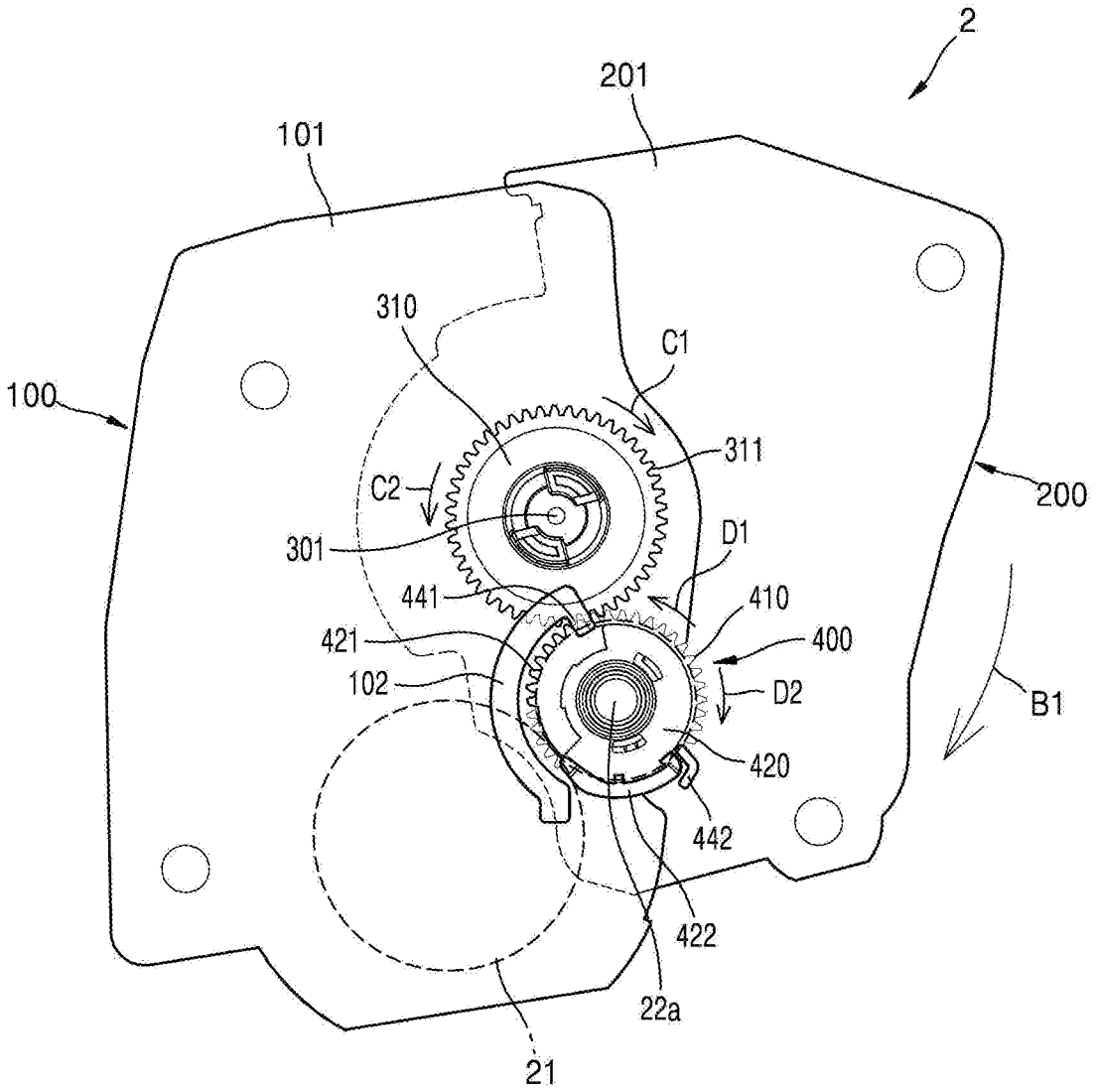
Figure 6B:
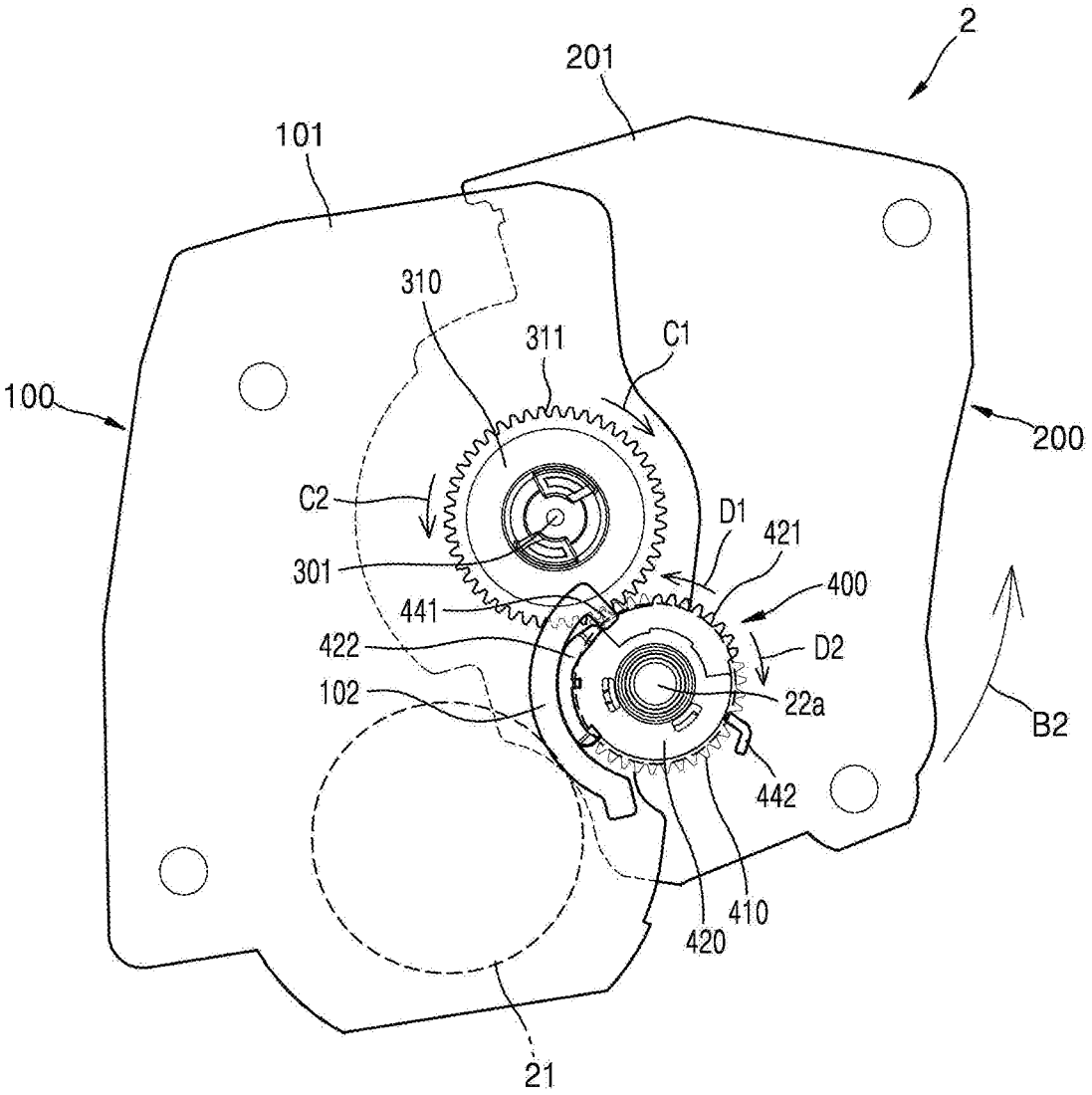

FIG. 4 is a perspective view of an example of the switching member 400, and FIG. 5 is an exploded perspective view of an example of the switching member 400 of FIG. 4. FIGS. 6A and 6B are schematic side views illustrating actions of the switching member 400 of FIG. 4, according to an example. FIG. 6A illustrates the switching member 400 in the second state, and FIG. 6B illustrates the switching member 400 in the first state.

Referring to FIGS. 4, 5, 6A, and 6B, the switching member 400 may include a driving gear 410, a cam member 420, and a clutch member. The driving gear 410 is supported to be rotatable about a rotation shaft 22*a* of the developing roller 22, and the rotation shaft 22*a* has a rotation axis. The driving gear 410 may be connected directly to a gear portion 311 of the coupler 310, or may be connected to the gear portion 311 of the coupler 310 via an idle gear (not shown). The cam member 420 is provided to be coaxial with a rotation axis of the driving gear 410. For example, the cam member 420 may be mounted on the rotation shaft 22*a* of the developing roller 22 and rotate about the rotation shaft 22*a* of the developing roller 22, or the cam member 420 may be mounted on a supporting shaft 411 of the driving gear 410 and rotate about a supporting shaft 411 extending from the driving gear 410.

The clutch member connects the cam member 420 to the driving gear 410 such that, when the driving gear 410 rotates in at least one of a first direction and a second direction, the driving gear 410 interlocks with a partial gear portion 421. The clutch member intermittently interlocks the driving gear 410 with the partial gear portion 421. According to an example, the clutch member may include a friction member 430. The friction member 430 is interposed between the driving gear 410 and the cam member 420 and provides a frictional force such that, when the driving gear 410 rotates, the cam member 420 may also rotate. The friction member 430 functions as a torque limiter or a clutch. When a load torque over the cam member 420 is greater than a friction torque provided by the frictional force, even when the driving gear 410 rotates, the cam member 420 does not rotate. When the load torque over the cam member 420 is less than the friction torque provided by the frictional force, the cam member 420 rotates together with the driving gear 410. The friction member 430 may be, for example, a Belleville spring or felt that is interposed between the driving gear 410 and the cam member 420.

The cam member 420 includes the partial gear portion 421 and a cam portion 422. The partial gear portion 421 may be intermittently (selectively) connected to the coupler 310. For example, the partial gear portion 421 intermittently (selectively) engages with the gear portion 311. The partial gear portion 421 may directly engage with the gear portion 311. The partial gear portion 421 may engage with the gear portion 311 interposing one or more idle gears therebetween. The partial gear portion 421 engages with the gear portion 311 or is separated from the gear portion 311, according to a rotation phase of the cam member 420. The cam portion 422 contacts or is separated from an interfering portion 102 (see FIGS. 6A and 6B) provided on the photoconductive unit 100 (for example, the first frame 101), according to the rotation phase of the cam member 420. The cam member 420 rotates to a first position where the cam portion 422 contacts the interfering portion 102 to rotate the developing unit 200 to the release position and to a second position where the cam portion 422 is separated from the interfering portion 102 to allow the developing unit 200 to rotate from the release position to the development position due to the elastic force of the elastic member 330, according to a rotating direction of the driving gear 410.

The development cartridge 2 may further include a first stopper 441 preventing the cam member 420 from rotating beyond the first position. When the cam member 420 reaches the first position, the cam portion 422 contacts the first stopper 441. The development cartridge 2 may further include a second stopper 442 preventing the cam member 420 from rotating beyond the second position. When the cam member 420 reaches the second position, the cam portion 422 contacts the second stopper 442.

Referring to FIG. 6A, first, the switching member 400 is in the second state. The cam member 420 is located at the second position. The cam portion 422 is separated from the interfering portion 102, and the partial gear portion 421 is separated from the gear portion 311. The cam portion 422 contacts the second stopper 442. The developing unit 200 maintains the development position due to the elastic force of the elastic member 330.

In the state shown in FIG. 6A, for printing, when the driving motor 40 arranged at the main body 1 rotates in a forward direction, the coupler 310 rotates in the direction C1. Then, the driving gear 410 is rotated in a direction D1 (first direction). The frictional force provided by the friction member 430 is applied to the cam member 420, but the cam portion 422 contacts the second stopper 442. Thus, slip occurs between the cam member 420 and the friction member 430 or between the friction member 430 and the driving gear 410, and the cam member 420 does not rotate. The partial gear portion 421 is maintained to be separated from the gear portion 311, and the switching member 400 is maintained in the second state. The cam member 420 is maintained at the second position. The developing roller 22 rotates in the direction D1. Thus, when the development nip N is formed, a printing operation may be performed.

During non-printing, when the driving motor 40 rotates in a backward direction in the state shown in FIG. 6A, the coupler 310 rotates in the direction C2. Then, the driving gear 410 is rotated in a direction D2 (second direction). The cam member 420 is rotated in the direction D2 together with the driving gear 410 due to the frictional force provided by the friction member 430. As the driving gear 410 rotates in the direction D2, the cam portion 422 is separated from the second stopper 442 and the partial gear portion 421 interlocks with the gear portion 311, and thus the switching member 400 is switched to the first state. When the driving motor 40 continuously rotates in the backward direction, a rotational force of the gear portion 311 is transmitted to the partial gear portion 421, and thus the cam member 420 rotates in the direction D2 and the cam portion 422 contacts the interfering portion 102. Because the position of the photoconductive unit 100 is fixed, the developing unit 200 rotates about the hinge axis 301 in the direction B2 and reaches the release position as shown in FIG. 6B, and the developing roller 22 is separated from the photoconductive drum 21 and the development nip N is released.

Even after interlocking between the partial gear portion 421 and the gear portion 311 is ended, the cam member 420 rotates in the direction D2 together with the driving gear 410 due to the frictional force provided by the friction member 430. When the cam portion 422 contacts the first stopper 441, the cam member 420 reaches the first position. Slip occurs between the cam member 420 and the friction member 430 or between the friction member 430 and the driving gear 410, and the cam member 420 does not rotate. The partial gear portion 421 is maintained to be separated from the gear portion 311, and the switching member 400 is maintained in the first state. When the driving motor 40 is stopped, the developing unit 200 tends to return to the development position due to the elastic force of the elastic member 330, but, because the cam portion 422 contacts the interfering portion 102, the developing unit 200 may be maintained at the release position.

When the driving motor 40 rotates in the forward direction again for printing in the state of FIG. 6B, the driving gear 410 rotates in the direction D1, and the cam member 420 rotates together with the driving gear 410 in the direction D1. The cam portion 422 is separated from the first stopper 441, and the partial gear portion 421 interlocks with the gear portion 311 again. The switching member 400 is switched to the second state. When the driving motor 40 continuously rotates in the forward direction, the rotational force of the gear portion 311 is delivered to the partial gear portion 421, and thus the cam member 420 rotates in the direction D1 and the cam portion 422 is separated from the interfering portion 102. Then, the developing unit 200 rotates about the hinge axis 301 to the development position due to the elastic force of the elastic member 330. As shown in FIG. 6A, the developing roller 22 contacts the photoconductive drum 21, and thus the development nip N is formed.

Even after interlocking between the gear portion 311 and the partial gear portion 421 is ended, the cam member 420 rotates in the direction D1 together with the driving gear 410 due to the frictional force provided by the friction member 430. As shown in FIG. 6A, when the cam portion 422 contacts the second stopper 442, the cam member 420 reaches the second position. Slip occurs between the cam member 420 and the friction member 430 or between the friction member 430 and the driving gear 410, and the cam member 420 does not rotate. The partial gear portion 421 is maintained to be separated from the gear portion 311, and, even when the driving motor 40 continuously rotates in the forward direction, the switching member 400 is maintained in the second state. The developing roller 22 rotates in the direction D1. Thus, when the development nip N is formed, a printing operation may be performed.

According to an example of the development cartridge 2, the driving gear 410 connected to the coupler 310 is rotated in the first direction (direction D1) and the second direction (direction D2) to switch the switching member 400 to the first and second states, thereby releasing/forming the development nip N. Thus, a mechanism for forming/releasing the development nip N does not need to be mounted on the main body 1, and thus the number of components included in the main body 1 may be reduced, costs for the components may be reduced, and the size of the main body 1 may be reduced. Because the development nip N may be released by a mechanism in the development cartridge 2, a disposable separation member for maintaining the development nip N in a released state may not be mounted on the development cartridge 2. Accordingly, user inconvenience of having to remove the disposable separation member before the development cartridge 2 is initially mounted on the main body 1 may be addressed. Because the switching member 400 is mounted on the rotation shaft 22*a* of the developing roller 22, a structure for forming/releasing the development nip N may become greatly compact. Because the development nip N may be formed/released by simply rotating the driving motor 40 in the forward direction and in the backward direction, a sensor for sensing whether the development nip N is formed/released is not necessary, timing control for forming/releasing the development nip N is easy, and noise is reduced.

Figure 7:
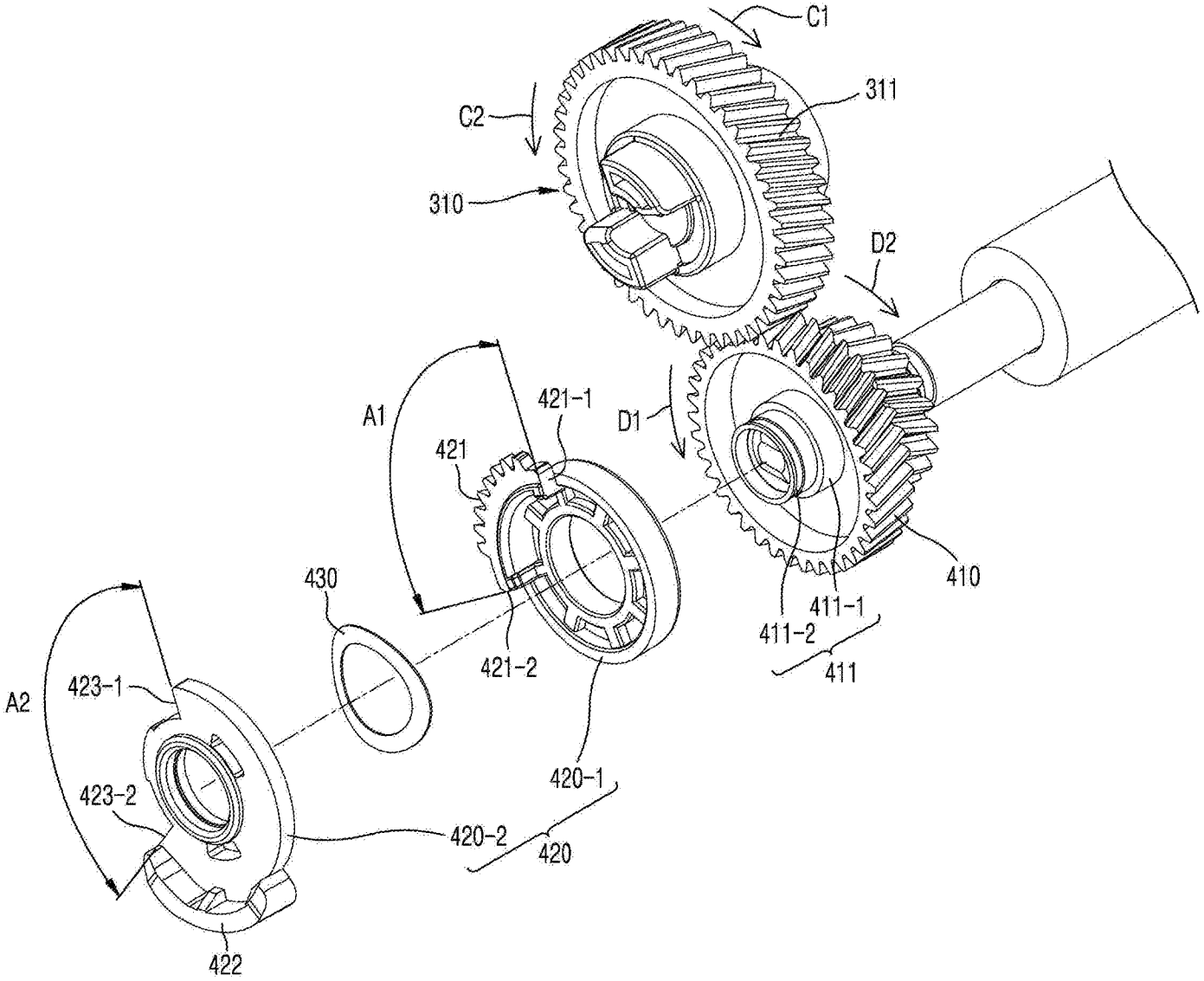
FIG. 7 is an exploded perspective view of a switching member according to an example.

FIG. 7 is an exploded perspective view of an example of the switching member 400. Referring to FIG. 7, the cam member 420 includes a first member 420-1 including the partial gear portion 421, and a second member 420-2 including the cam portion 422. The first and second members 420-1 and 420-2 are provided to be coaxial with the rotation shaft 22*a* of the developing roller 22. For example, the first and second members 420-1 and 420-2 may be mounted to be rotatable about the rotation shaft 22*a* of the developing roller 22. As illustrated in FIG. 7, the first and second members 420-1 and 420-2 may be supported by the supporting shaft 411 and be rotatable about the supporting shaft 411 provided on the driving gear 410. For example, the supporting shaft 411 may include first and second supporting shafts 411-1 and 411-2 which support the first and second members 420-1 and 420-2 such that the first and second members 420-1 and 420-2 are rotatable. The friction member 430 provides a frictional force such that, when the driving gear 410 rotates, the first member 420-1 may also rotate. The friction member 430 may apply pressure to the first member 420-1 toward the driving gear 410. According to the example, the friction member 430 may be interposed between the first and second members 420-1 and 420-2, or the friction member 430 may be interposed between the first member 420-1 and the driving gear 410. The friction member 430 may be, for example, a Belleville spring or felt.

The second member 420-2 is rotated by being pushed by the first member 420-1. A first end 421-1 of the partial gear portion 421 in the direction D2 faces a third end 423-1 of the second member 420-2, and a second end 421-2 of the partial gear portion 421 in the direction D1 faces a fourth end 423-2 of the second member 420-2. Accordingly, when the first member 420-1 rotates in the direction D2, the first end 421-1 pushes the third end 423-1 so that the second member 420-2 rotates in the direction D2, and, when the first member 420-1 rotates in the direction D1, the second end 421-2 pushes the fourth end 423-2 so that the second member 420-2 rotates in the direction D1. An angle A2 between the third end 423-1 and the fourth end 423-2 may be greater than an angle A1 between the first end 421-1 and the second end 421-2. For example, the angle A2 may be greater than the angle A1 by about 20° to about 30°. Accordingly, there may be an idle section of about 20° to about 30° between the first member 420-1 and the second member 420-2, and, when the switching member 400 is switched to the first or second state, a delay time corresponding to about 20° to about 30° may be secured.

The example of the switching member 400 of FIG. 7 is different from the switching member 400 of FIGS. 4 and 5 in that the cam member 420 is divided into the first and second members 420-1 and 420-2. Accordingly, a process of forming/releasing the development nip N will now be described in brief with reference to FIGS. 6A, 6B, and 7.

Referring to FIG. 6A, first, the switching member 400 is in the second state. The cam portion 422 is separated from the interfering portion 102, and the partial gear portion 421 is separated from the gear portion 311. The cam portion 422 contacts the second stopper 442. The cam member 420 is located at the second position. The developing unit 200 maintains the development position due to the elastic force of the elastic member 330.

In the state shown in FIG. 6A, for printing, when the driving motor 40 arranged at the main body 1 rotates in a forward direction, the coupler 310 rotates in the direction C1. Then, the driving gear 410 rotates in the direction D1. The first member 420-1 receives the frictional force provided by the friction member 430 and thus receives a rotational force in the direction D1, and the second end 421-2 pushes the fourth end 423-2. However, because the cam portion 422 contacts the second stopper 442, the second member 420-2 does not rotate. Thus, the first and second members 420-1 and 420-2 do not rotate, the partial gear portion 421 is maintained to be separated from the gear portion 311, and the switching member 400 is maintained in the second state. The developing roller 22 rotates in the direction D1. Thus, when the development nip N is formed, a printing operation may be performed During non-printing, when the driving motor 40 rotates in a backward direction in the state shown in FIG. 6A, the coupler 310 rotates in the direction C2. Then, the driving gear 410 rotates in the direction D2. The first member 420-1 rotates in the direction D2 together with the driving gear 410, due to the frictional force provided by the friction member 430. When the first end 421-1 contacts the third end 423-1, the second member 420-2 rotates in the direction D2. The cam portion 422 is separated from the second stopper 442 and the partial gear portion 421 interlocks with the gear portion 311, and thus the switching member 400 is switched to the first state. When the driving motor 40 continuously rotates in the backward direction, the first and second members 420-1 and 420-2 rotate in the direction D2 and the cam portion 422 contacts the interfering portion 102. The developing unit 200 rotates about the hinge axis 301 in the direction B2 and reaches the release position as shown in FIG. 6B, and the developing roller 22 is separated from the photoconductive drum 21 and the development nip N is released.

Even after interlocking between the partial gear portion 421 and the gear portion 311 is ended, the first and second members 420-1 and 420-2 rotate in the direction D2 together with the driving gear 410 due to the frictional force provided by the friction member 430. When the cam portion 422 contacts the first stopper 441, the first and second members 420-1 and 420-2 do not rotate. The cam member 420 is maintained at the first position. The partial gear portion 421 is maintained to be separated from the gear portion 311, and the switching member 400 is maintained in the first state. When the driving motor 40 is stopped, the developing unit 200 tends to return to the development position due to the elastic force of the elastic member 330, but, because the cam portion 422 contacts the interfering portion 102, the developing unit 200 may be maintained at the release position.

When the driving motor 40 rotates in the forward direction again for printing in the state of FIG. 6B, the driving gear 410 rotates in the direction D1, and the first member 420-1 rotates together with the driving gear 410 in the direction D1. Until the second end 421-2 contacts the fourth end 423-2, the second member 420-2 does not rotate. The partial gear portion 421 interlocks with the gear portion 311 again, and, when the second end 421-2 contacts the fourth end 423-2, the second member 420-2 rotates together with the first member 420-1 in the direction D1. The cam portion 422 is separated from the first stopper 421, and the switching member 400 is switched to the second state. When the driving motor 40 continuously rotates in the forward direction, the first and second members 420-1 and 420-2 rotate in the direction D1 and the cam portion 422 is separated from the interfering portion 102. Then, the developing unit 200 rotates about the hinge axis 301 to the development position due to the elastic force of the elastic member 330. As shown in FIG. 6A, the developing roller 22 contacts the photoconductive drum 21, and thus the development nip N is formed. Even after interlocking between the gear portion 311 and the partial gear portion 421 is ended, the first and second members 420-1 and 420-2 may rotate in the direction D2 together with the driving gear 410 due to the frictional force provided by the friction member 430. As shown in FIG. 6A, when the cam portion 422 contacts the second stopper 442, the second member 420-2 does not rotate, and the cam member 420 is maintained at the second position. The partial gear portion 421 is maintained to be separated from the gear portion 311, and, even when the driving motor 40 continuously rotates in the forward direction, the switching member 400 is maintained in the second state. The developing roller 22 rotates in the direction D1. Thus, when the development nip N is formed, a printing operation may be performed.

Figure 8:
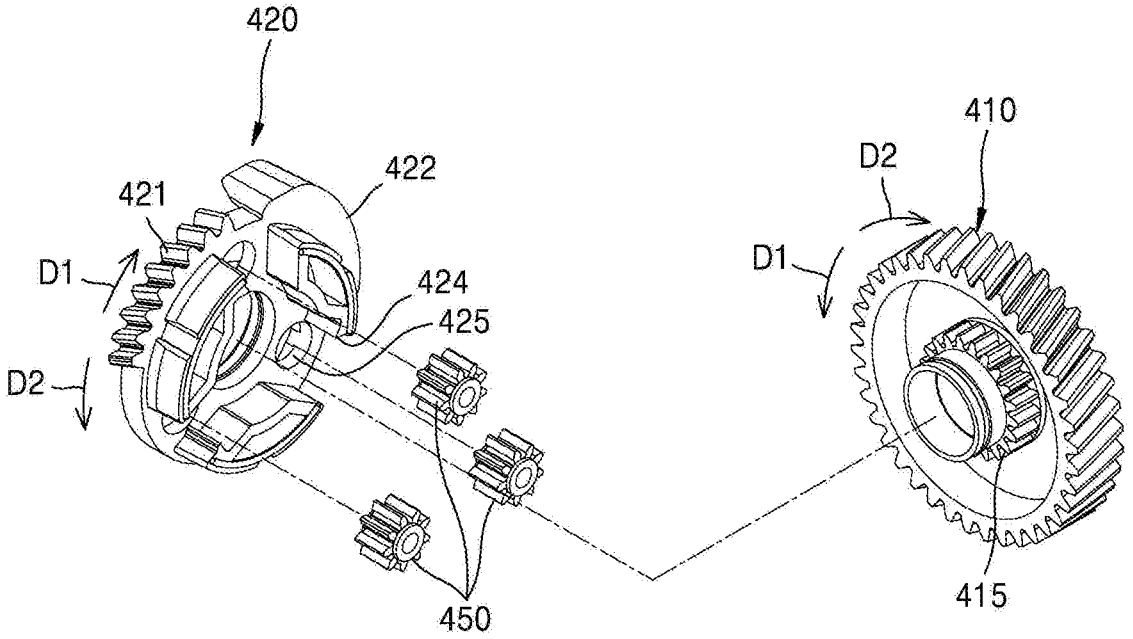
FIG. 8 is an exploded perspective view of a switching member according to an example.
Figure 9:
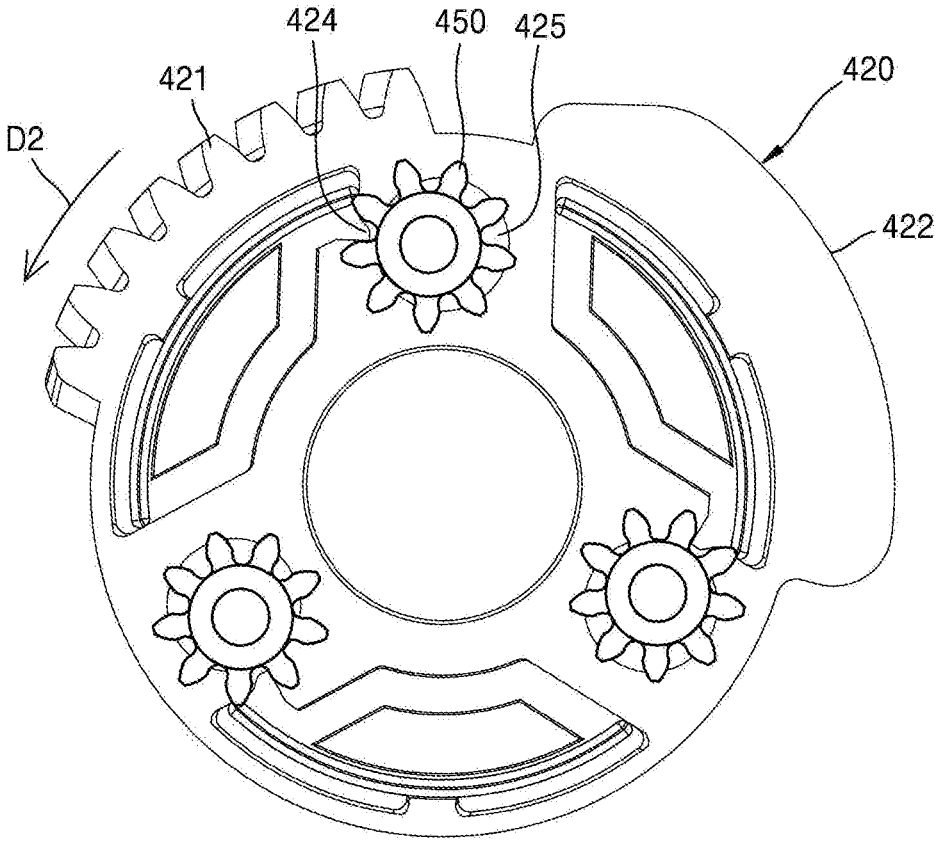
FIG. 9 illustrates when a driving gear rotates in a direction D1, in the example of the switching member of FIG. 8.
Figure 10:
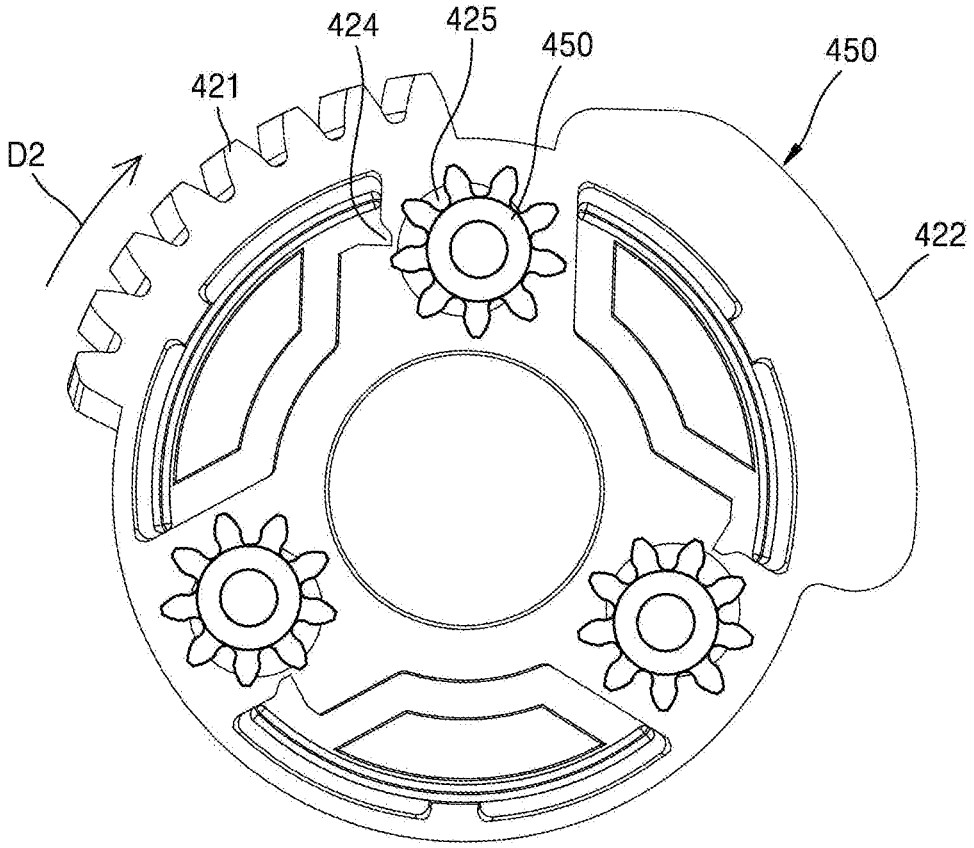
FIG. 10 illustrates when the driving gear rotates in a direction D2, in the example of the switching member of FIG. 8.

FIG. 8 is an exploded perspective view of an example of the switching member 400. FIG. 9 illustrates when the driving gear 410 rotates in the direction D1, in the example of the switching member 400 of FIG. 8. FIG. 10 illustrates when the driving gear 410 rotates in the direction D2 in the example of the switching member 400 of FIG. 8.

Referring to FIG. 8, the switching member 400 includes the driving gear 410, the cam member 420, and a latch gear 450. The cam member 420 includes the partial gear portion 421, the cam portion 422, a latch portion 424, and a guiding portion 425 having a long hole shape. The guiding portion 425 enables the latch gear 450 to swing and rotate therein. The driving gear 410 interlocks with the gear portion 311 of the coupler 310 and rotates. The driving gear 410 includes a first inner gear portion 415. The first inner gear portion 415 interlocks with the latch gear 450. The latch gear 450 moves along the guiding portion 425 to a position (FIG. 9) where the latch gear 450 interlocks with the latch portion 424 and a position (FIG. 10) where the latch gear 450 is separated from the latch portion 512, according to a rotation direction of the driving gear 410. The clutch member may be implemented by the latch portion 424, the guiding portion 425, the first inner gear portion 415, and the latch gear 450.

When the driving gear 410 rotates in the direction D2, the latch gear 450 swings in the rotation direction of the driving gear 410 along the guiding portion 425 and interlocks with the latch portion 424, as shown in FIG. 9. In this state, the latch gear 450 does not rotate, and the cam member 420 rotates together with the driving gear 410 in the direction D2. When the driving gear 410 rotates in the direction D2, the latch gear 450 swings in the rotation direction of the driving gear 410 along the guiding portion 425 and is separated from the latch portion 424, as shown in FIG. 10. The latch gear 450 rotates within the guiding portion 425. Accordingly, the rotational force of the driving gear 410 in the direction D2 is not transmitted to the cam member 420.

The example of the switching member 400 of FIG. 8 is different from the switching member 400 of FIGS. 4 and 5 in that a clutching structure using the latch gear 450 is employed between the driving gear 410 and the cam member 420. Accordingly, a process of forming/releasing the development nip N will now be described in brief with reference to FIGS. 6A, 6B, and 8.

Referring to FIG. 6A, first, the switching member 400 is in the second state. The cam member 420 is located at the second position. The cam portion 422 is separated from the interfering portion 102, and the partial gear portion 421 is separated from the gear portion 311. The cam portion 422 contacts the second stopper 442. The driving gear 410 interlocks with the gear portion 311. The developing unit 200 maintains the development position due to the elastic force of the elastic member 330.

In the state shown in FIG. 6A, for printing, when the driving motor 40 arranged at the main body 1 rotates in a forward direction, the coupler 310 rotates in the direction C1. Then, the driving gear 410 rotates in the direction D1. The latch gear 450 swings in the direction D1 along the guiding portion 425 and is separated from the latch portion 424, as shown in FIG. 10. The latch gear 450 rotates within the guiding portion 425. Accordingly, the cam member 420 does not rotate and maintains the second position. The partial gear portion 421 is maintained to be separated from the gear portion 311, and the switching member 400 is maintained in the second state. The developing roller 22 rotates in the direction D1. Thus, when the development nip N is formed, a printing operation may be performed.

During non-printing, when the driving motor 40 rotates in a backward direction in the state shown in FIG. 6A, the coupler 310 rotates in the direction C2. Then, the driving gear 410 rotates in the direction D2. The latch gear 450 swings in the direction D2 along the guiding portion 425 and interlocks with the latch portion 424, as shown in FIG. 9. In this state, the latch gear 450 does not rotate, and the cam member 420 rotates together with the driving gear 410 in the direction D2. The cam portion 422 is separated from the second stopper 442 and the partial gear portion 421 interlocks with the gear portion 311, and thus the switching member 400 is switched to the first state. When the driving motor 40 continuously rotates in the backward direction, the cam portion 422 contacts the interfering portion 102. The developing unit 200 rotates about the hinge axis 301 in the direction B2 and reaches the release position as shown in FIG. 6B, and the developing roller 22 is separated from the photoconductive drum 21 and the development nip N is released.

The cam member 420 reaches the first position. At this time, the partial gear portion 421 and the gear portion 311 are in mesh with each other. When the driving motor 40 is stopped, the cam member 420 is maintained in mesh with the partial gear portion 421 and the gear portion 311 at the first position. The developing unit 200 is maintained at the release position.

When the driving motor 40 rotates in the forward direction again for printing in the state of FIG. 6B, the driving gear 410 rotates in the direction D1. The latch gear 450 swings in the direction D1 along the guiding portion 425 and is separated from the latch portion 424, as shown in FIG. 10. Because the partial gear portion 421 and the gear portion 311 are in mesh with each other, the cam member 420 rotates in the direction D1 together with the driving gear 410. The cam portion 422 is separated from the first stopper 421, and the switching member 400 is switched to the second state. When the cam portion 422 is separated from the interfering portion 102, the developing unit 200 rotates about the hinge axis 301 to the development position due to the elastic force of the elastic member 330, and, as shown in FIG. 6A, the developing roller 22 contacts the photoconductive drum 21 and the development nip N is formed. The interlocking between the gear portion 311 and the partial gear portion 421 is ended, and, when the cam portion 422 contacts the second stopper 442, the cam member 420 reaches the second position and does not rotate. The partial gear portion 421 is separated from the gear portion 311, and, even when the driving motor 40 continuously rotates in the forward direction, the switching member 400 is maintained in the second state. The developing roller 22 rotates in the direction D1. Thus, when the development nip N is formed, a printing operation may be performed.

When the switching member 400 of FIG. 8 is employed, the first stopper 441 is not necessary. In this case, at the release position (first position of the cam member 420), the partial gear portion 421 and the gear portion 311 are maintained in mesh with each other. At the development position (second position of the cam member 420), the cam portion 422 contacts the second stopper 422, and the partial gear portion 421 and the gear portion 311 are separated from each other.

Figure 11:
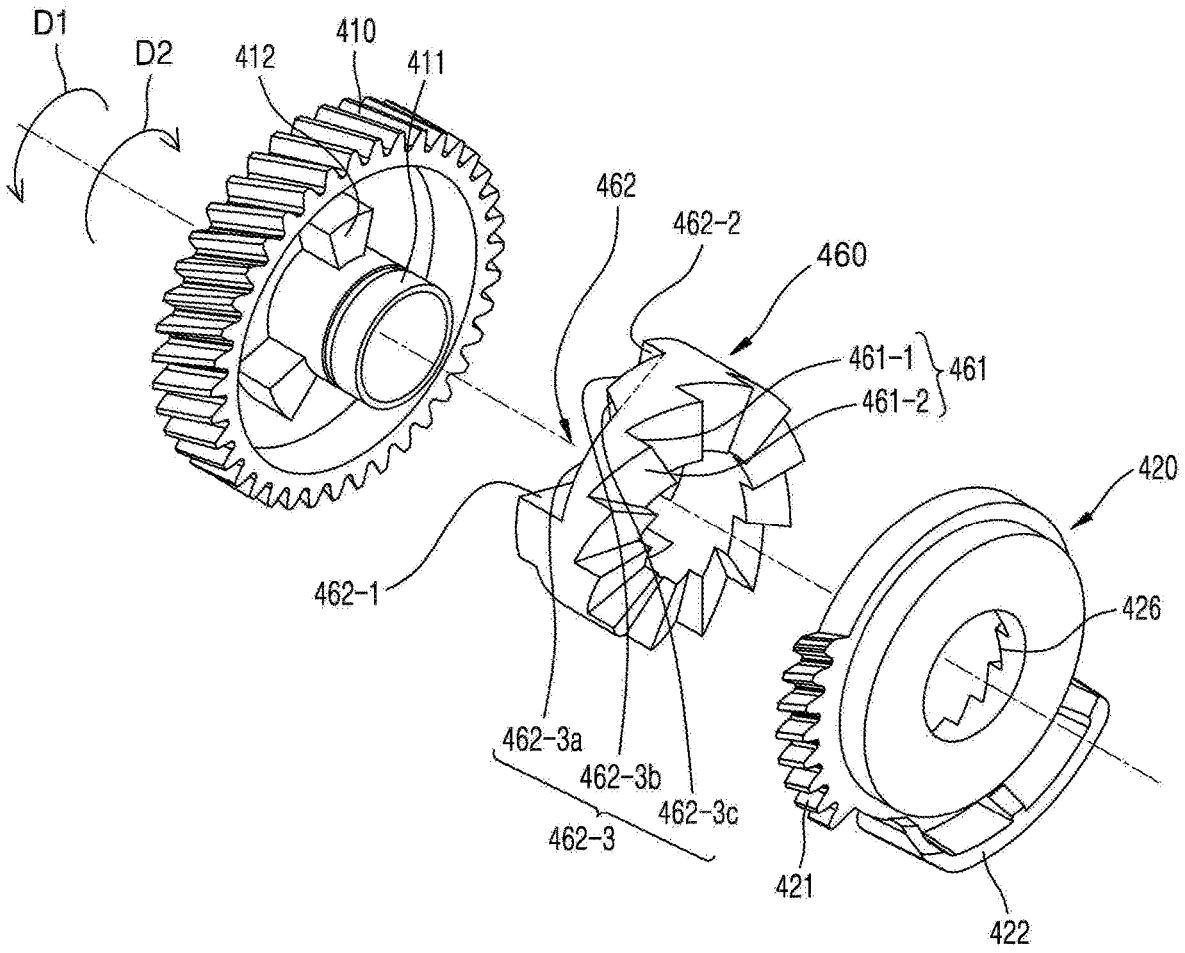
FIG. 11 is an exploded perspective view of a switching member according to an example.

FIG. 11 is an exploded perspective view of an example of the switching member 400. Referring to FIG. 11, the switching member 400 includes the driving gear 410, a latch member 460, and the cam member 420. The latch member 460 and the cam member 420 are provided to be coaxial with as the rotation shaft 22*a* of the developing roller 22. For example, the latch member 460 and the cam member 420 may be mounted on the rotation shaft 22*a* of the developing roller 22 and be rotatable about the rotation shaft 22*a* of the developing roller 22. As illustrated in FIG. 11, the latch member 460 and the cam member 420 may be supported by the support shaft 411 and be rotatable about the support shaft 411 provided on the driving gear 410.

A first latch portion 461 is provided on the latch member 460. The first latch portion 461 may include a plurality of opposite portions 461-1 arranged in a circumferential direction to transmit a rotational force, and inclined portions 461-2 sequentially connecting the plurality of opposite portions 461-1 to each other. The cam member 420 includes a second latch portion 426 having a complementary shape to the first latch portion 461. The first and second latch portions 461 and 426 have shapes capable of transmitting a rotational force in the direction D2. In other words, when the latch member 460 rotates in the direction D2, the first and second latch portions 461 and 426 interlock with each other, and thus the cam member 420 rotates in the direction D2, and, when the latch member 460 rotates in the direction D1, the first and second latch portions 461 and 426 are separated from each other by the inclined portions 461-2, and the cam member 420 does not rotate.

A first protrusion 412 is provided on the driving gear 410. A concave portion 462, onto which the first protrusion 412 fits, is provided on the latch member 460. The concave portion 462 includes first and second opposite surfaces 462-1 and 462-2, and a connecting surface 462-3 connecting the first and second opposite surfaces 462-1 and 462-2 to each other. When the driving gear 410 rotates in the direction D1, the first protrusion 412 contacts the first opposite surface 462-1 to thereby rotate the latch member 460 in the direction D1. When the driving gear 410 rotates in the direction D2, the first protrusion 412 contacts the second opposite surface 462-2 to thereby rotate the latch member 460 in the direction D2. When the driving gear 410 rotates in the direction D2, the connecting surface 462-3 guides the first protrusion 412 such that the latch member 460 is pushed toward the cam member 420. For example, a depth of a portion of the connecting surface 462-3 near the first opposite surface 462-1 is greater than that of a portion of the connecting surface 462-3 near the second opposite surface 462-2. The connecting surface 462-3 may be an inclined surface (indicated by a dotted line) of which a depth gradually decreases in a direction from the first opposite surface 462-1 to the second opposite surface 462-2. The connecting surface 462-3 may include a first connecting surface 462-3*a* located near the first opposite surface 462-1, a second connecting surface 462-3*b* having a smaller depth than the first connecting surface 462-3*a* and positioned near the second opposite surface 462-2, and a third connecting surface 462-3*c* which is inclined and connects the first and second connecting surfaces 462-3*a* and 462-3*b* to each other.

According to this structure, the clutch member may be implemented by the first and second latch portions 461 and 426, the first protrusion 412, and the concave portion 462. When the driving gear 410 rotates in the direction D1, the first protrusion 412 contacts the first opposite surface 462-1, and the latch member 460 rotates in the direction D1. However, because the first and second latch portions 461 and 426 are separated from each other, the cam member 420 does not rotate. When the driving gear 410 rotates in the direction D2, the first protrusion 412 contacts the second opposite surface 462-2, and the latch member 460 rotates in the direction D2. The first and second latch portions 461 and 426 interlock with each other, and thus the cam member 420 also rotates in the direction D2.

The example of the switching member 400 of FIG. 11 is different from the switching member 400 of FIGS. 4 and 5 in that the latch gear 450 is interposed between the driving gear 410 and the cam member 420. Accordingly, a process of forming/releasing the development nip N will now be described in brief with reference to FIGS. 6A, 6B, and 11.

Referring to FIG. 6A, first, the switching member 400 is in the second state. The cam portion 422 is separated from the interfering portion 102, and the partial gear portion 421 is separated from the gear portion 311. The cam portion 422 contacts the second stopper 442. The cam member 420 is located at the second position. The developing unit 200 maintains the development position due to the elastic force of the elastic member 330.

In the state shown in FIG. 6A, for printing, when the driving motor 40 arranged at the main body 1 rotates in a forward direction, the coupler 310 rotates in the direction C1. Then, the driving gear 410 rotates in the direction D1. The first protrusion 412 contacts the first opposite surface 462-1, and the latch member 460 rotates in the direction D1. Because the first and second latch portions 461 and 426 are spaced from each other, the cam member 420 does not rotate. The cam member 420 is maintained at the second position, the partial gear portion 421 is maintained to be separated from the gear portion 311, and the switching member 400 is maintained in the second state. The developing roller 22 rotates in the direction D1. Thus, when the development nip N is formed, a printing operation may be performed.

During non-printing, when the driving motor 40 rotates in a backward direction in the state shown in FIG. 6A, the coupler 310 rotates in the direction C2. Then, the driving gear 410 rotates in the direction D2. The first protrusion 412 is separated from the first opposite surface 462-1 and is guided to the connecting surface 462-3. Because the depth of the connecting surface 462-3 decreases in the direction D2, the latch member 460 is pushed toward the cam member 420. When the first protrusion 412 contacts the second opposite surface 462-2, the latch member 460 rotates in the direction D2. While the first and second latch portions 461 and 426 are interlocking with each other, the cam member 420 rotates in the direction D2. The cam portion 422 is separated from the second stopper 442 and the partial gear portion 421 interlocks with the gear portion 311, and thus the switching member 400 is switched to the first state. When the driving motor 40 continuously rotates in the backward direction, the cam portion 422 contacts the interfering portion 102. The developing unit 200 rotates about the hinge axis 301 in the direction B2 and reaches the release position as shown in FIG. 6B, and the developing roller 22 is separated from the photoconductive drum 21 and the development nip N is released.

The cam member 420 reaches the first position. When the partial gear portion 421 and the gear portion 311 are in mesh with each other, the driving motor 40 is stopped. The developing unit 200 is maintained at the release position.

When the driving motor 40 rotates in the forward direction again for printing in the state of FIG. 6B, the driving gear 410 rotates in the direction D1. Because the partial gear portion 421 and the gear portion 311 are in mesh with each other, the cam member 420 also rotates in the direction D1. Then, due to actions of the first and second latch portions 461 and 426, the latch member 460 is pushed toward the driving gear 410. At this time, the first protrusion 412 is separated from the second opposite surface 462-2 and is moved toward the first opposite surface 462-2, and the depth of the connecting surface 462-3 increases in a direction from the second opposite surface 462-2 to the first opposite surface 462-1, and thus the latch member 460 is allowed to be pushed toward the driving gear 410. The cam portion 422 is separated from the first stopper 421, and the switching member 400 is switched to the second state. When the driving motor 40 continuously rotates in the forward direction, the first and second latch portions 461 and 426 are completely separated from each other, and the cam member 420 rotates in the direction D1 due to interlocking between the partial gear portion 421 and the gear portion 311. When the cam portion 422 is separated from the interfering portion 102, the developing unit 200 rotates about the hinge axis 301 to the development position due to the elastic force of the elastic member 330. As shown in FIG. 6A, the developing roller 22 contacts the photoconductive drum 21, and thus the development nip N is formed. When the interlocking between the gear portion 311 and the partial gear portion 421 is ended and the cam portion 422 contacts the second stopper 442, the cam member 420 does not rotate and is maintained at the second position. The partial gear portion 421 is maintained to be separated from the gear portion 311, and, even when the driving motor 40 continuously rotates in the forward direction, the switching member 400 is maintained in the second state. The developing roller 22 rotates in the direction D1. Thus, when the development nip N is formed, a printing operation may be performed.

When the switching member 400 of FIG. 11 is employed, the first stopper 441 is not necessary. In this case, at the release position (first position of the cam member 420), the partial gear portion 421 and the gear portion 311 are maintained in mesh with each other. At the development position (second position of the cam member 420), the cam portion 422 contacts the second stopper 422, and the partial gear portion 421 and the gear portion 311 are separated from each other.

During image formation, the photoconductive drum 21 and the developing roller 22 rotate in the forward direction. The photoconductive drum 21 may rotate in the backward direction as necessary. For example, when recycled paper is frequently used as the recording medium P, foreign substances detached from recycled paper may be trapped between the photoconductive drum 21 and the cleaning blade 25, and thus a line-shaped printing defect in a lengthwise direction (rotation direction of the photoconductive drum 21) may appear on a printed image. To remove the foreign substances, the driving motor 40 may be driven in the backward direction such that the photoconductive drum 21 may rotate in the backward direction. At this time, the developing roller 22 may rotate in the backward direction. As such, when the developing roller 22 rotates in the backward direction, toner may leak between the bottom sealing member 29 and the developing roller 22 having relatively low contact pressures. The leaked toner is transported to an area where the regulation member 28 is mounted, as the developing roller 22 rotates in the backward direction. Because a contact pressure of the regulation member 28 with respect to the developing roller 22 is higher than that of the bottom sealing member 29 with respect to the developing roller 22, toner does not pass between the regulation member 28 and the developing roller 22. Accordingly, toner may be accumulated near the regulation member 28 and may drop into the image forming apparatus, thereby contaminating the image forming apparatus. When the developing roller 22 rotates in the forward direction again, the toner accumulated near the regulation member 28 may be detached from the developing roller 22 to thereby contaminate the image forming apparatus. A lateral sealing member (not shown) is disposed between both ends of the developing roller 22 in a lengthwise direction and both ends of the toner containing unit 209. When the developing roller 22 repeatedly rotates in the forward direction and the backward direction, the developing roller 22 repeatedly interferes with the lateral sealing member while repeatedly moving in the lengthwise direction due to a thrust force, and thus sealing performance is degraded. Thus, toner may outwardly leak from the toner containing unit 209, and the developing roller 22 may be damaged. In addition, when the developing roller 22 rotates in the backward direction, the regulation member 28 mounted according to a counter manner may be deformed, and thus regulation performance of the regulation member 28 may be degraded, or the regulation member 28 may be destroyed.

As such, to address this issue, when the driving motor 40 is driven in the backward direction, the rotational force of the driving motor 40 may be prevented from being transmitted to the developing roller 22 during a certain rotation section.

Figure 12:
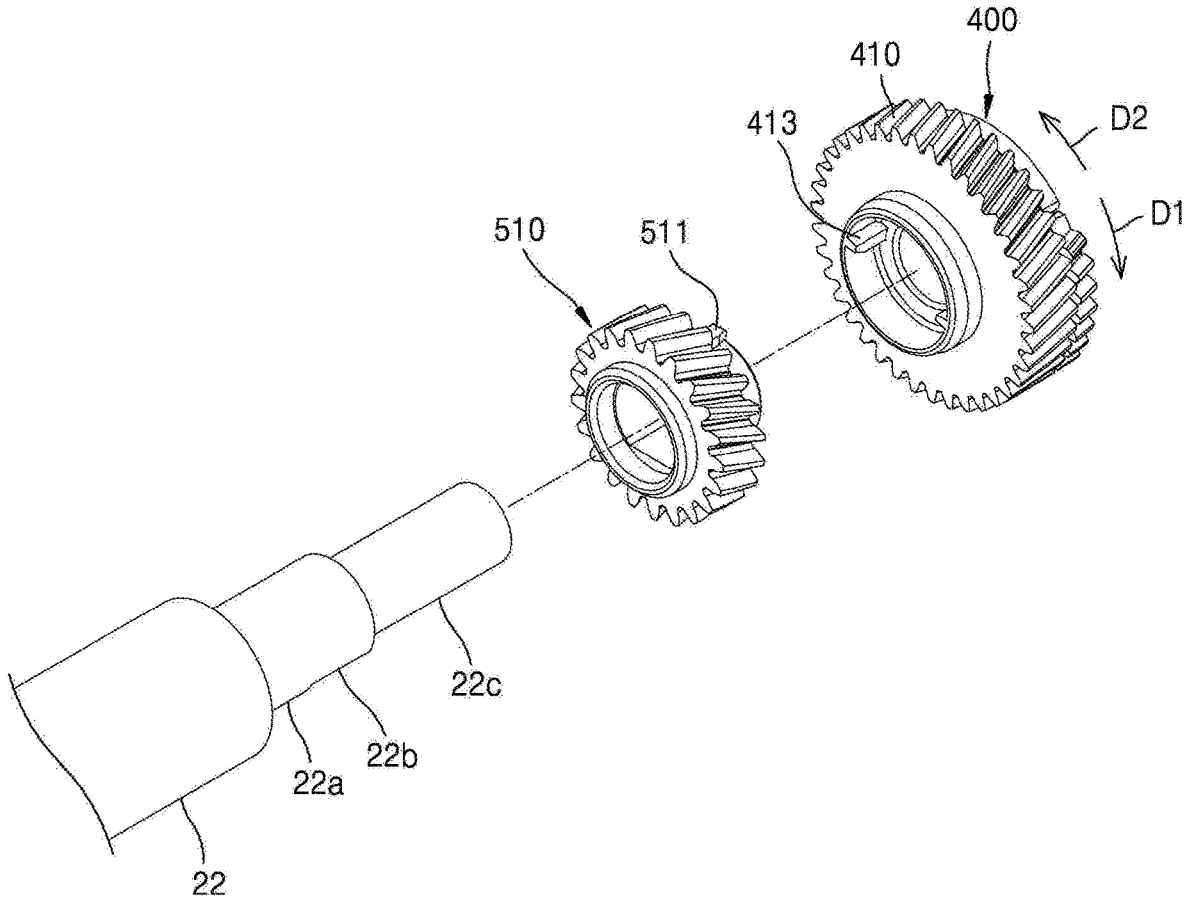
FIG. 12 is a perspective view of an example of a structure for driving a developing roller.

FIG. 12 is a perspective view of an example of a structure for driving the developing roller 22. Referring to FIG. 12, a bush 510 is fixed to the rotation shaft 22*a* of the developing roller 22. For example, a D-cut portion 22*b* may be provided on the rotation shaft 22*a*, and a shape that is complementary to the D-cut portion 22*b* may be provided on the bush 510. Further, the rotation shaft 22*a* of the developing roller may also include an end portion 22*c* further along the rotation shaft 22*a* than the D-cut portion 22*b*, to support the driving gear 410. A power transmission member is employed, which transmits the rotational force of the driving gear 410 to the bush 510 when the driving gear 410 rotates in the direction D1, and partially interrupts transmission of the rotational force of the driving gear 410 to the bush 510 when the driving gear 410 rotates in the direction D2. For example, a second protrusion 413 is provided on the driving gear 410. An interlocking portion 511 to be interlocked with the second protrusion 413 is provided on the bush 510. The interlocking portion 511 may be a protrusion that protrudes toward the driving gear 410, as shown in FIG. 12.

When the driving gear 410 rotates in the direction D1, the second protrusion 413 contacts the interlocking portion 511, and the bush 510 rotates in the direction D1. When the driving gear 410 rotates in the direction D2, the second protrusion 413 is separated from the interlocking portion 511. Until the driving gear 410 makes one rotation in the direction D2 and the second protrusion 413 contacts the interlocking portion 511, the bush 510 does not rotate. While the bush 510 is not rotating, the switching member 400 may rotate the developing unit 200 from the development position to the release position. A sum L1 of lengths (angles) of the interlocking portion 511 and the second protrusion 413 in a circumferential direction may be appropriately determined by considering a rotational angle L2 of the driving gear 410 in the direction D2 while the developing unit 200 is being rotated from the development position to the release position. In other words, the lengths (angles) of the interlocking portion 511 and the second protrusion 413 may be determined such that 360−L1>L2 is established.

Figure 13:
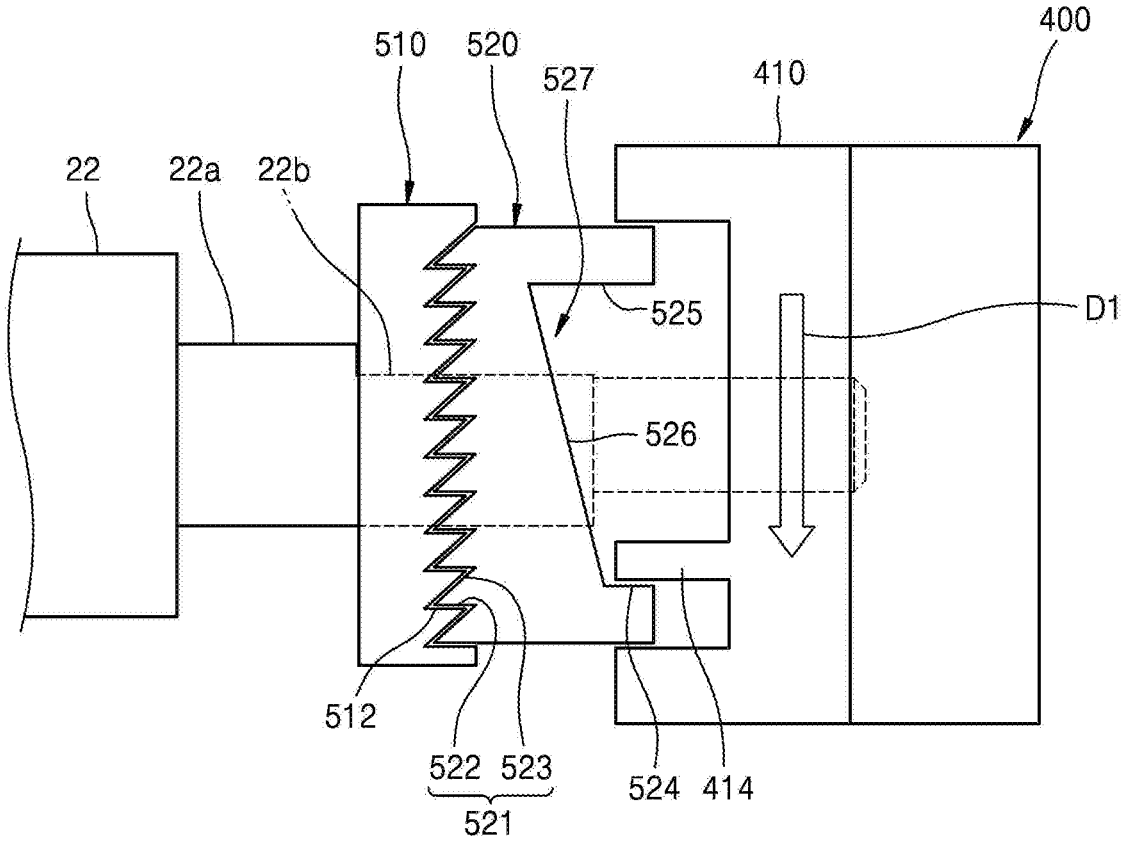
Figure 14:
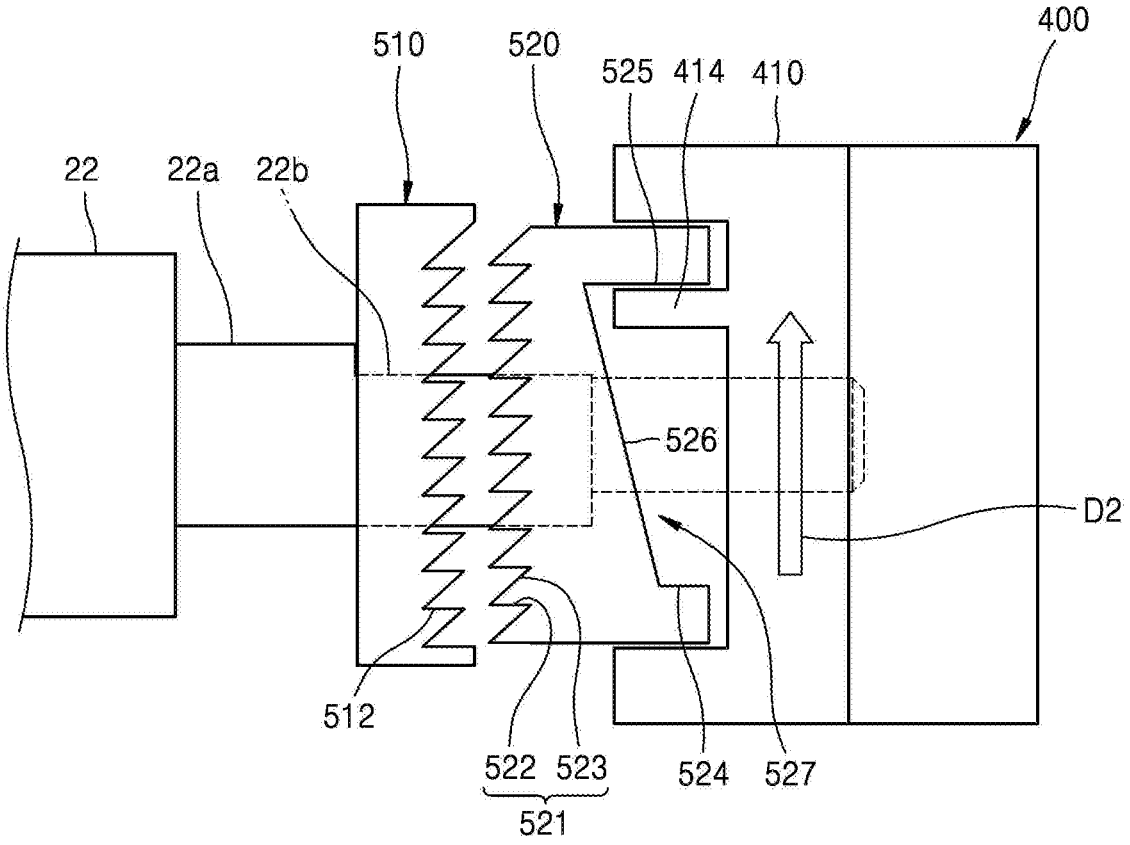

When the driving motor 40 is driven in the backward direction, the rotational force of the driving motor 40 may be prevented from being transmitted to the developing roller 22. In other words, a power transmission member may be employed, which transmits the rotational force of the driving gear 410 to the developing roller 22 when the driving gear 410 rotates in the direction D1. A latch structure shown in FIG. 11 may be used as the power transmission member. FIGS. 13 and 14 are schematic side views of a power transmission member according to an example, wherein FIG. 13 illustrates the case where the driving gear 410 rotates in the direction D1 and FIG. 14 illustrates the case where the driving gear 410 rotates in the direction D2.

Referring to FIGS. 13 and 14, the bush 510 is fixed to the rotation shaft 22*a* of the developing roller 22. A development latch member 520 is mounted on the rotation shaft 22*a* of the developing roller 22 and is rotatable about the rotation shaft 22*a* of the developing roller 22. A first latch portion 521 is provided on the development latch member 520. The first latch portion 521 may include a plurality of opposite portions 522 arranged in a circumferential direction to transmit a rotational force, and inclined portions 523 sequentially connecting the plurality of opposite portions 522 to each other. The bush 510 includes a second latch portion 512 having a complementary shape to the first latch portion 521. The first and second latch portions 521 and 512 have shapes capable of transmitting a rotational force in the direction D1. In other words, when the development latch member 520 rotates in the direction D1, the first and second latch portions 521 and 512 interlock with each other, and thus the bush 510 rotates in the direction D1, and, when the development latch member 520 rotates in the direction D2, the first and second latch portions 521 and 512 are separated from each other by the inclined portions 523, and the bush 510 does not rotate.

A protrusion 414 is provided on the driving gear 410. A concave portion 527, into which the protrusion 414 is inserted, is provided on the development latch member 520. The concave portion 527 includes first and second opposite surfaces 524 and 525, and a connecting surface 526 connecting the first and second opposite surfaces 524 and 525 to each other. When the driving gear 410 rotates in the direction D1, the protrusion 414 contacts the first opposite surface 524 to thereby rotate the development latch member 520 in the direction D1. When the driving gear 410 rotates in the direction D2, the protrusion 414 contacts the second opposite surface 525 to thereby rotate the development latch member 520 in the direction D2. When the driving gear 410 rotates in the direction D1, the connecting surface 526 guides the protrusion 414 such that the development latch member 520 is pushed toward the bush 510. For example, a depth of a portion of the connecting surface 526 near the first opposite surface 524 is less than that of a portion of the connecting surface 526 near the second opposite surface 525. The connecting surface 526 may be a structure including two stepped surfaces and an inclined connecting surface that connects the two stepped surfaces to each other, like the connecting surface 462-3 of FIG. 11.

According to such a structure, as shown in FIG. 13, when the driving gear 410 rotates in the direction D1, the protrusion 414 contacts the first opposite surface 524, and the development latch member 520 rotates in the direction D1. The first and second latch portions 521 and 512 interlock with each other, and thus the bush 510 also rotates in the direction D1. When the driving gear 410 rotates in the direction D2, the protrusion 414 contacts the second opposite surface 525, and the development latch member 520 rotates in the direction D2. However, as shown in FIG. 14, due to actions of the first and second latch portions 521 and 512, the development latch member 520 is pushed toward the driving gear 410, and thus the first and second latch portions 521 and 512 are separated from each other. Accordingly, the bush 510 does not rotate. In this state, when the driving gear 410 rotates in the direction D1 again, while the protrusion 414 is moving from the second opposite surface 525 to the first opposite surface 524, the protrusion 414 pushes the connecting surface 526, and thus the developing latch member 520 is pushed toward the bush 510. Then, the first and second latch portions 521 and 512 interlock with each other. As shown in FIG. 13, when the driving gear 410 continuously rotates in the direction D1, the protrusion 414 contacts the first opposite surface 524, and the development latch member 520 rotates in the direction D1. The first and second latch portions 521 and 512 interlock with each other, and thus the bush 510 also rotates in the direction D1.

Figure 15:
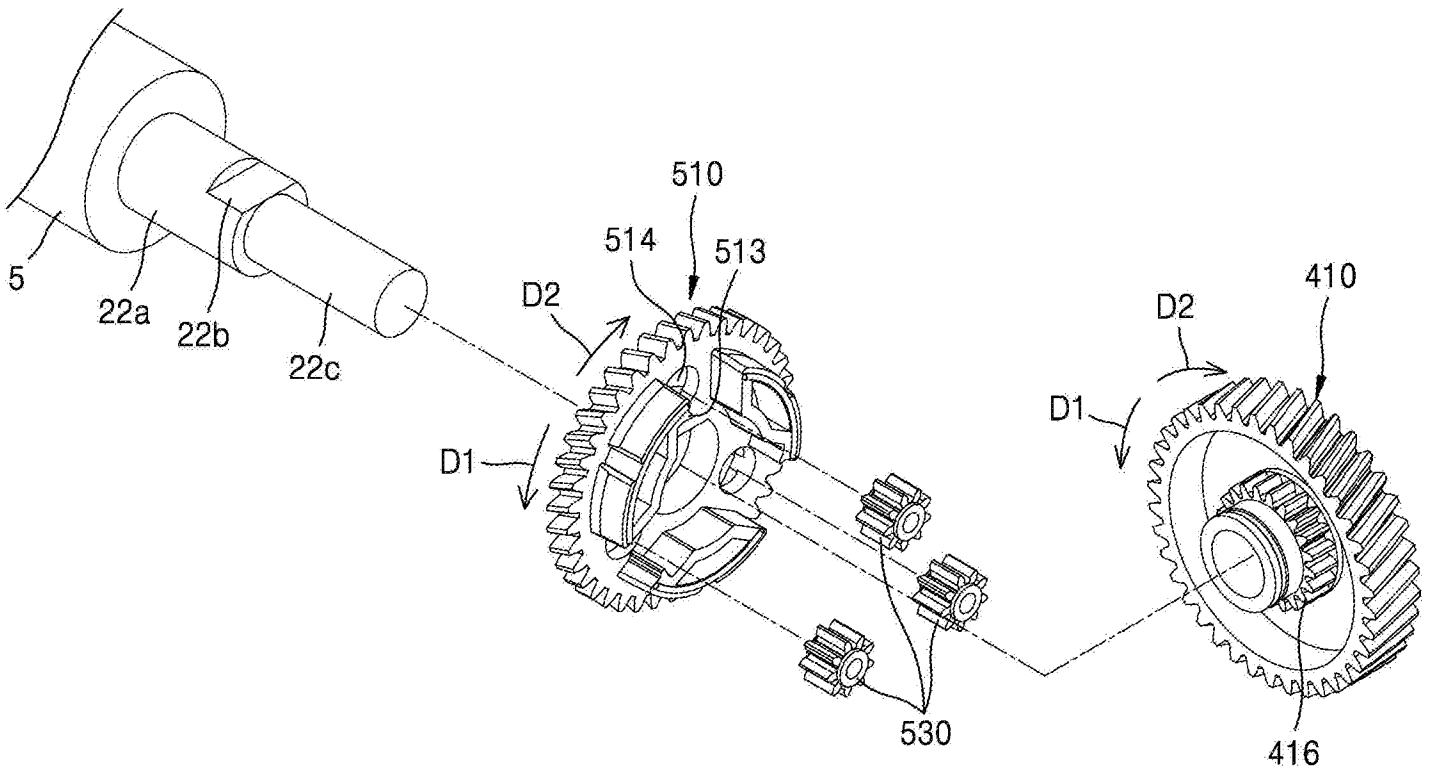
FIG. 15 is a schematic exploded perspective view of a power transmission member according to an example.
Figure 16:
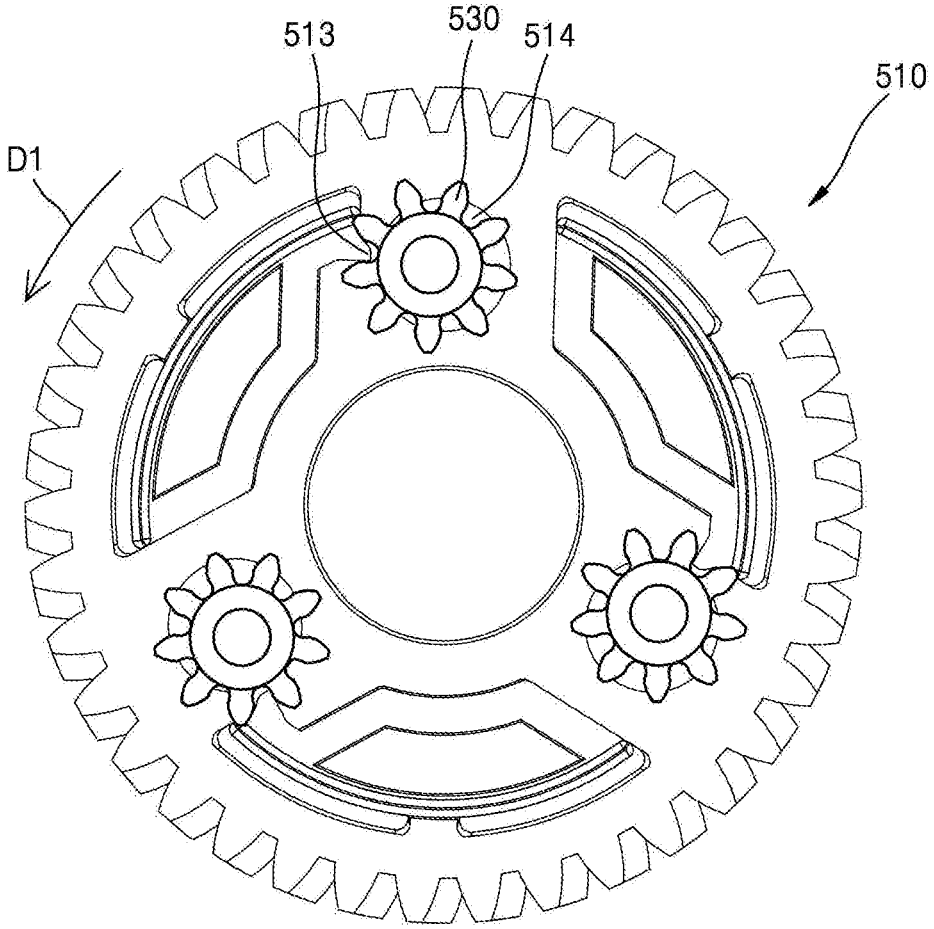
FIG. 16 illustrates when the driving gear rotates in the direction D1, in the example of the power transmission member of FIG. 15.
Figure 17:
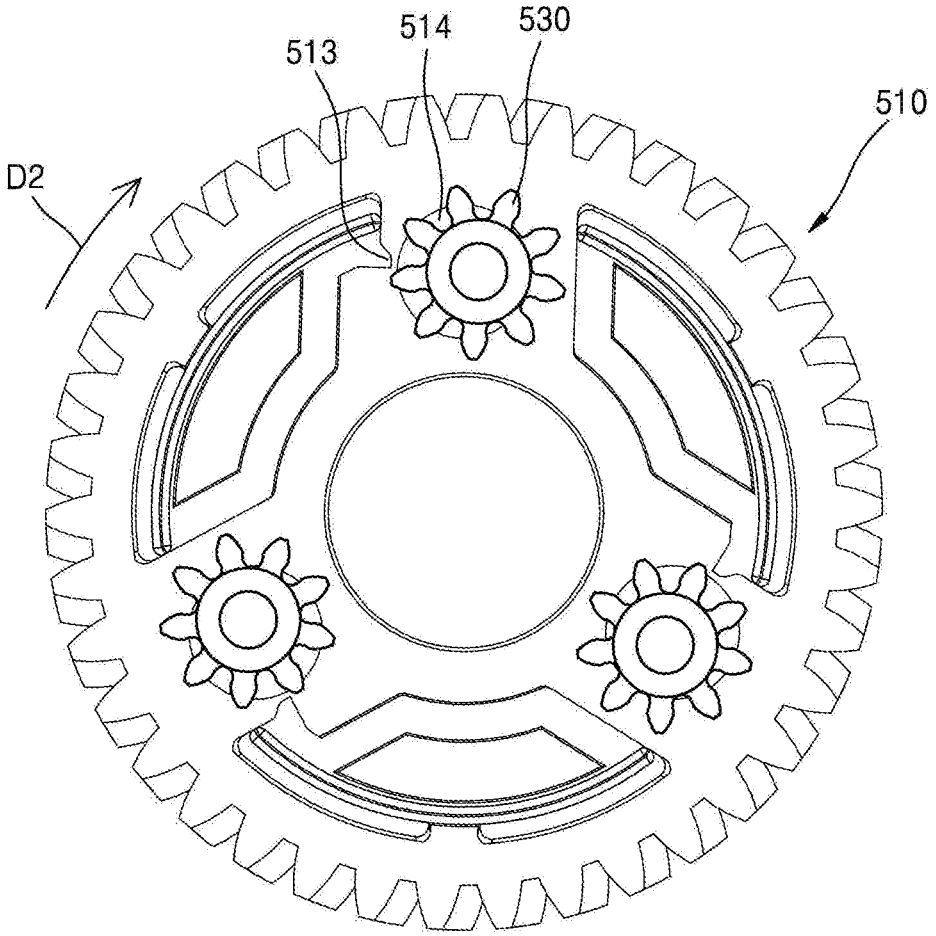
FIG. 17 illustrates when the driving gear rotates in the direction D2, in the example of the power transmission member of FIG. 15.

The latch structure of FIGS. 8-10 may be used as the structure for driving the developing roller 22. FIG. 15 is a schematic exploded perspective view of a power transmission member according to an example. FIG. 16 illustrates when the driving gear 410 rotates in the direction D1, in the example of the power transmission member of FIG. 15. FIG. 17 illustrates when the driving gear 410 rotates in the direction D2, in the example of the power transmission member of FIG. 15.

FIG. 15 illustrates the driving gear 410, a latch gear 530, and the bush 510. The bush 510 includes a latch portion 513, and a guiding portion 514 having a long hole shape. The guiding portion 514 enables the latch gear 530 to swing and rotate therein. The driving gear 410 includes a second inner gear portion 416. The second inner gear portion 416 interlocks with the latch gear 530. The latch gear 530 moves along the guiding portion 514 to a position (FIG. 16) where the latch gear 530 interlocks with the latch portion 513 and a position (FIG. 17) where the latch gear 530 is separated from the latch portion 513, according to a rotation direction of the driving gear 410.

When the driving gear 410 rotates in the direction D1, the latch gear 530 swings in the rotation direction of the driving gear 410 along the guiding portion 514 and interlocks with the latch portion 513, as shown in FIG. 16. In this state, the latch gear 530 does not rotate, and the bush 510 rotates together with the driving gear 410 in the direction D1. When the driving gear 410 rotates in the direction D2, the latch gear 530 swings in the direction D2 along the guiding portion 514 and is separated from the latch portion 513, as shown in FIG. 17. The latch gear 530 rotates within the guiding portion 514. Accordingly, the rotational force of the driving gear 410 in the direction D2 is not transmitted to the bush 510, and the bush 510 does not rotate.

A structure for driving the developing roller 22 is not limited to the examples of FIGS. 11-17, and various structures capable of rotating the developing roller 22 when the driving gear 410 rotates in the direction D1 may be employed. According to this structure, the possibility that toner leaks may be reduced.

In the structures for driving the developing roller 22 according to the examples of FIGS. 11-17, the gear provided on the outer circumference of the bush 510 is used to drive other rotational members of the developing unit 200, for example, the supply roller 27, and is not a necessary component to be included in a structure for driving the developing roller 22.

While the disclosure has been particularly shown and described with reference to various examples thereof, it will be understood that various changes in form and details may be made therein without departing from the spirit and scope as defined by the following claims.

What is claimed is:

1. A development cartridge, comprising:

a photoconductive unit including a photoconductive drum;

a developing unit including a developing roller having a rotation shaft and coupled to the photoconductive unit to be rotatable to a release position where the developing roller is separated from the photoconductive drum, and to a development position where the developing roller contacts the photoconductive drum to form a development nip; and a coupler located between and couplable to the rotation shaft of the developing roller and a rotational power transmission member, such that when the coupler is coupled to the rotational power transmission member, the coupler is selectively rotatable about an axis of rotation of the developing roller in a first rotation direction or a second rotation direction by a rotational force from the rotational power transmission member, and when a part of the rotational power transmission member, which is rotatable about the axis of rotation of the developing roller, is rotated in the first rotation direction and then rotated in the second rotation direction, transmission of the rotational force to the developing roller via the coupler is temporarily stopped.

2. The development cartridge according to claim 1, wherein the rotational force is provided to the rotational power transmission member by a driving gear, the rotational power transmission member to transmit the rotational force of the driving gear to the coupler when the driving gear rotates in a first driving gear direction, corresponding to the first rotation direction of the rotational power transmission member, and to block the rotational force of the driving gear to the coupler when the driving gear rotates in a second driving gear direction, corresponding to the second rotation direction of the rotational power transmission member.

3. The development cartridge according to claim 2, further comprising a switching member mounted on the rotation shaft of the developing roller to be rotatable about the rotation shaft of the developing roller by being coupled to a second coupler, wherein the switching member includes the driving gear having a rotation axis and provided to be rotatable about the rotation shaft of the developing roller by being coupled to the second coupler.

4. An image forming apparatus, comprising:

a main body; and the development cartridge of claim 1, detachable from the main body.

5. The development cartridge according to claim 1, further comprising a driving gear to provide the rotational force to the rotational power transmission member, when the driving gear rotates in a first driving gear direction, corresponding to the first rotation direction of the rotational power transmission member, the rotational power transmission member is to transmit the rotational force of the driving gear to the coupler, and when the driving gear switches from rotating in the first driving gear direction to rotate in a second driving gear direction, corresponding to the second rotation direction of the rotational power transmission member, the rotational power transmission member is to stop transmission of the rotational force of the driving gear to the coupler for a time corresponding to a time for the driving gear to rotate a preset rotational angle in the second driving gear direction.

6. The development cartridge according to claim 1, wherein the coupler is fixed to the rotation shaft of the developing roller.

7. A development cartridge, comprising:

a photoconductive unit including a photoconductive drum;

a developing unit including a developing roller having a rotation shaft and coupled to the photoconductive unit to be rotatable to a release position where the developing roller is separated from the photoconductive drum, and to a development position where the developing roller contacts the photoconductive drum to form a development nip;

a coupler located between and couplable to the rotation shaft of the developing roller and a rotational power transmission member, such that when the coupler is coupled to the rotational power transmission member, the coupler is selectively rotatable in a first rotation direction or a second rotation direction by a rotational force from the rotational power transmission member, and when the coupler is rotated in the first rotation direction and then a part of the rotational power transmission member is rotated in the second rotation direction, transmission of the rotational force to the developing roller is temporarily stopped;

a switching member mounted on the rotation shaft of the developing roller to be rotatable about the rotation shaft of the developing roller by being coupled to a second coupler, wherein the switching member includes a driving gear having a rotation axis and provided to be rotatable about the rotation shaft of the developing roller by being coupled to the second coupler, wherein the rotational force is provided to the rotational power transmission member by the driving gear, the rotational power transmission member to transmit the rotational force of the driving gear to the coupler when the driving gear rotates in a first driving gear direction, corresponding to the first rotation direction of the rotational power transmission member, and to block the rotational force of the driving gear to the coupler when the driving gear rotates in a second driving gear direction, corresponding to the second rotation direction of the rotational power transmission member.

8. The development cartridge according to claim 7, wherein the rotational power transmission member includes:

a protrusion provided on the driving gear; and an interlocking portion provided on the coupler, which interlocks with the protrusion, and given that a sum of lengths of the interlocking portion and the protrusion in a circumferential direction is L1 and a rotational angle of the driving gear in the second driving gear direction while the developing unit is being rotated from the development position to the release position is L2, wherein 360−L1>L2.

9. The development cartridge according to claim 7, wherein the rotational power transmission member includes:

a development latch member positioned on a same axis as the rotation axis of the driving gear between the driving gear and the coupler, and movable in an axial direction;

a protrusion provided on the driving gear;

a concave portion provided on the development latch member such that the protrusion fits onto the concave portion, and the concave portion includes:

a first opposite surface that the protrusion contacts when the driving gear rotates in the first driving gear direction to thereby rotate the development latch member in a first development latch member direction, and a second opposite surface that the protrusion contacts when the driving gear rotates in the second driving gear direction to thereby rotate the development latch member in a second development latch member direction, to thereby transmit the rotational force of the driving gear to the development latch member as a rotational force of the development latch member, and a connecting surface that connects the first opposite surface and the second opposite surface to each other and guides the protrusion such that, when the driving gear rotates in the first driving gear direction, the development latch member is pushed toward the coupler; and a first latch portion provided on the development latch member and a second latch portion provided on the coupler, the first latch portion and the second latch portion interlocking with each other to transmit the rotational force of the development latch member to the coupler when the development latch member rotates in the first development latch member direction and separated from each other when the developmental latch member rotates in the second development latch member direction.

10. The development cartridge according to claim 7, wherein the rotational power transmission member includes:

a latch portion and a guiding portion having a long hole shape, provided on the coupler;

a second inner gear portion provided on the driving gear; and a latch gear interlocking with the second inner gear portion, provided on the guiding portion of the coupler, and interlocking with the latch portion of the coupler, such that the coupler rotates together with the driving gear, when the driving gear rotates in the first driving gear direction, and the latch gear is separated from the latch portion when the driving gear rotates in the second driving gear direction.

11. The development cartridge according to claim 7, further comprising an elastic member to provide an elastic force to maintain the developing unit at the development position, wherein the second coupler is couplable to a driving motor provided in a main body of an image forming apparatus, wherein when the second coupler is coupled to the driving motor, the second coupler is rotatable in at least one of two coupler directions, wherein when the second coupler is rotated in the at least one of two coupler directions, the switching member is switched to a first state where the switching member contacts an interfering portion of the photoconductive unit to rotate the developing unit to the release position, and when the second coupler is rotated in the other of the at least one of two coupler directions, the switching member is switched to a second state where the switching member is separated from the interfering portion of the photoconductive unit to allow the developing unit to allow the developing unit to rotate to the development position due to the elastic force of the elastic member.

12. The development cartridge according to claim 11, wherein the switching member includes:

a cam member including a cam portion and a partial gear portion, the partial gear portion selectively interlocked with the second coupler, and the cam member provided to be coaxial with the rotation axis of the driving gear and being rotatable; and a clutch member to connect the cam member to the driving gear such that, when the driving gear rotates in at least one of the two driving gear directions, the clutch member connects the cam member to the driving gear and the cam member rotates with the driving gear, wherein when the partial gear portion of the cam member interlocks with the second coupler the switching member switches to the first state and the second state by the cam member rotating to a first position, corresponding to the first state, where the cam portion contacts the interfering portion of the photoconductive unit to rotate the developing unit to the release position, and to a second position, corresponding to the second state, where the cam portion is separated from the interfering portion of the photoconductive unit to allow the developing unit to rotate from the release position to the development position due to the elastic force of the elastic member.

13. The development cartridge according to claim 12, wherein the driving gear is to rotate in the first driving gear direction during printing and is to rotate in the second driving gear direction during non-printing, and the cam member is to rotate to the second position when the driving gear rotates in the first driving gear direction and is to rotate to the first position when the driving gear rotates in the second driving gear direction.

14. The development cartridge according to claim 13, further comprising:

a first stopper to contact the cam portion to stop the cam member from rotating beyond the first position when the cam member is rotated to the first position; and a second stopper to contact the cam portion to stop the cam member from rotating beyond the second position when the cam member is rotated to the second position, wherein the clutch member includes a friction member to provide a frictional force between the cam member and the driving gear.

15. The development cartridge according to claim 14, wherein the clutch member includes:

a latch portion and a guiding portion having a long hole shape, provided on the cam member;

a first inner gear portion provided on the driving gear; and a latch gear interlocking with the first inner gear portion, provided on the guiding portion of the cam member, and interlocking with the latch portion such that the cam member rotates together with the driving gear, when the driving gear rotates in the second driving gear direction, and the cam member is separated from the latch portion, when the driving gear rotates in the first driving gear direction.

16. The development cartridge according to claim 14, wherein the clutch member includes:

a latch member positioned on a same axis as the rotation axis of the driving gear between the driving gear and the cam member, and movable in an axial direction;

a second protrusion provided on the driving gear;

a concave portion provided on the latch member such that the second protrusion fits onto the concave portion, and the concave portion includes a first opposite surface that the second protrusion contacts when the driving gear rotates in the first driving gear direction to thereby rotate the latch member in a first latch member direction, and a second opposite surface that the second protrusion contacts when the driving gear rotates in the second driving gear direction to thereby rotate the latch member in a second latch member direction, and a connecting surface that connects the first opposite surface and the second opposite surface to each other and guides the second protrusion such that, when the driving gear rotates in the second driving gear direction, the latch member is pushed toward the cam member; and a first latch portion provided on the latch member and a second latch portion provided on the cam member, the first latch portion and the second latch portion being separated from each other when the latch member rotates in the first latch member direction and interlocking with each other when the latch member rotates in the second latch member direction such that the cam member rotates with the latch member.

17. The development cartridge according to claim 13, wherein when the cam member is at the first position, the partial gear portion is separated from the second coupler, and when the cam member is at the second position, the partial gear portion is separated from the second coupler.

18. The development cartridge according to claim 13, wherein the cam member further includes a first member including the partial gear portion, and a second member including the cam portion, and the second member is rotated by being pushed by the first member, when the cam member is at the first position, the partial gear portion is separated from the second coupler, and when the cam member is at the second position, the partial gear portion is separated from the second coupler.

19. The development cartridge according to claim 18, wherein the first member further includes a first end that pushes the second member when the first member rotates in the first driving gear direction;

the first member further includes a second end that pushes the second member when the first member rotates in the second driving gear direction;

the second member further includes a third end and a fourth end corresponding to the first end and the second end, respectively, and an angle between the third end and the fourth end is greater than an angle between the first end and the second end.

20. An image forming apparatus, comprising:

a main body; and the development cartridge of claim 7, detachable from the main body.

21. A development cartridge, comprising:

a photoconductive unit including a photoconductive drum;

a developing unit including a developing roller having a rotation shaft and coupled to the photoconductive unit to be rotatable to a release position where the developing roller is separated from the photoconductive drum, and to a development position where the developing roller contacts the photoconductive drum to form a development nip;

a driving gear, rotatable about an axis of rotation of the rotation shaft of the developing roller;

a power transmission member; and a bush, disposed between the rotation shaft of the developing roller and the power transmission member, and coupled to the rotation shaft of the developing roller, and when the driving gear rotates in a first direction, the power transmission member is to transmit a rotational force of the driving gear to the bush, and when the driving gear rotates in the second direction, a part of the power transmission member is to temporarily stop the rotational force of the driving gear from being transmitted to the bush, so that the bush does not rotate and transmission of the rotational force to the developing roller via the bush is temporarily stopped.

22. The development cartridge according to claim 21, wherein the power transmission member includes:

a protrusion provided on the driving gear, and an interlocking portion provided on the bush, which interlocks with the protrusion and protrudes toward the driving gear.

23. The development cartridge according to claim 22, wherein when the driving gear rotates in the first direction, the protrusion is to contact the interlocking portion to transmit the rotational force of the driving gear to the bush to rotate the bush in the first direction, and when the driving gear rotates in the second direction, the protrusion is separated from the interlocking portion so as to stop the rotational force of the driving gear from being transmitted to the bush, so that the bush does not rotate and transmission of the rotational force to the developing roller via the bush is temporarily stopped.

24. The development cartridge according to claim 21, wherein when the driving gear switches from rotating in the first direction to rotate in the second direction, the power transmission member is to stop transmission of the rotational force of the driving gear to the bush for a time corresponding to a half rotation of the driving gear in the second direction.

25. An image forming apparatus, comprising:

a main body; and the development cartridge of claim 21, detachable from the main body.

* * * * *